US012698730B2

(12) United States Patent
McWhirter

(10) Patent No.: US 12,698,730 B2
(45) Date of Patent: Aug. 4, 2026

(54) AMBIENT TEMPERATURE THERMAL ADAPTER FOR SUPERCRITICAL CARBON DIOXIDE POWER CYCLE

(71) Applicant: TerraPower, LLC, Bellevue, WA (US)

(72) Inventor: Jon D McWhirter, Kirkland, WA (US)

(73) Assignee: TERRAPOWER, LLC, Bellevue, WA (US)

( * ) Notice: Subject to any disclaimer, the term of this patent is extended or adjusted under 35 U.S.C. 154(b) by 0 days.

(21) Appl. No.: 19/036,900

(22) Filed: Jan. 24, 2025

(65) Prior Publication Data

US 2025/0243790 A1 Jul. 31, 2025

Related U.S. Application Data

(60) Provisional application No. 63/559,100, filed on Feb. 28, 2024, provisional application No. 63/625,215, filed on Jan. 25, 2024.

(51) Int. Cl.
*F01K 25/10* (2006.01)
*F01K 3/18* (2006.01)
(Continued)

(52) U.S. Cl.
CPC ..... *F01K 25/103* (2013.01); *F01K 3/181* (2013.01); *F01K 7/32* (2013.01); *F01K 9/003* (2013.01); *F25B 9/002* (2013.01)

(58) Field of Classification Search
CPC ..... F01K 25/103; F01K 3/181; F01K 7/32; F01K 9/003; F25B 9/002
See application file for complete search history.

(56) References Cited

U.S. PATENT DOCUMENTS 4,765,143 A * 8/1988 Crawford ..... F01K 3/00 60/671
4,856,288 A * 8/1989 Weber ..... F25B 41/385 62/149
(Continued)

FOREIGN PATENT DOCUMENTS

CN 109979150 A 7/2019
CN 115617621 A 1/2023
(Continued)

OTHER PUBLICATIONS

International Search Report and Written Opinion for International Application No. PCT/IN2024/051071, dated Nov. 5, 2024, 11 Pages.

*Primary Examiner* — Hoang M Nguyen
(74) *Attorney, Agent, or Firm* — FisherBroyles, LLP; Jeremy P. Sanders

(57) ABSTRACT

A refrigeration cycle is connected to a supercritical carbon dioxide (sCO2) power cycle by incorporating a CO2 condenser which is also the refrigeration cycle evaporator. The heat rejected by the carbon dioxide is absorbed by the refrigerant in the CO2 condenser. Work is done on the refrigerant to raise its temperature above the local ambient temperature. The heat absorbed from the power cycle and the work required to raise the refrigerant temperature is rejected to the ambient environment, which may be either air, earth, or water. This results in improved efficiencies in carbon dioxide power cycles without regard to the ambient temperature by forcing a transcritical phase change even when ambient temperatures are above the carbon dioxide critical point. A two-phase heat transfer on both sides of the CO2 condenser further improves efficiency of the sCO2 power cycle.

17 Claims, 12 Drawing Sheets

(51) Int. Cl.

| | |
|---|---|
| ***F01K 7/32*** | (2006.01) |
| ***F01K 9/00*** | (2006.01) |
| ***F25B 9/00*** | (2006.01) |

(56) References Cited

U.S. PATENT DOCUMENTS

| | | | | |
|---|---|---|---|---|
| 8,904,791 | B2 * | 12/2014 | Lehar | F01K 25/103 60/671 |
| 11,480,160 | B1 * | 10/2022 | Mokheimer | F03G 4/001 |
| 2012/0102996 | A1 * | 5/2012 | Freund | F01K 23/04 62/476 |
| 2012/0304673 | A1 * | 12/2012 | Betts | H01M 8/04029 62/238.1 |
| 2013/0033044 | A1 * | 2/2013 | Wright | F22B 3/08 60/773 |
| 2013/0133327 | A1 * | 5/2013 | Milam | F01K 25/08 60/651 |
| 2015/0376801 | A1 * | 12/2015 | Bairamijamal | C25B 9/05 518/704 |
| 2016/0047361 | A1 * | 2/2016 | Al-Sulaiman | F03G 6/064 60/641.15 |
| 2022/0186884 | A1 * | 6/2022 | Sbarsi | F17C 5/06 |
| 2023/0160606 | A1 * | 5/2023 | Mokheimer | F03G 6/067 126/620 |
| 2023/0313711 | A1 * | 10/2023 | MacDonald | F02C 7/10 60/783 |

FOREIGN PATENT DOCUMENTS

| | | | |
|---|---|---|---|
| TR | 202015478 | A2 | 12/2020 |
| WO | 2022135813 | A1 | 6/2022 |

* cited by examiner

AMBIENT TEMPERATURE THERMAL ADAPTER FOR SUPERCRITICAL CARBON DIOXIDE POWER CYCLE

CROSS REFERENCE

The present application claim benefit of priority to U.S. Provisional Patent Application No. 63/625,215, filed Jan. 25, 2024, titled "AMBIENT TEMPERATURE THERMAL ADAPTER FOR SUPERCRITICAL CARBON DIOXIDE POWER CYCLE" and to U.S. Provisional Patent Application No. 63/559,100, filed Feb. 28, 2024, titled "AMBIENT TEMPERATURE THERMAL ADAPTER FOR SUPERCRITICAL CARBON DIOXIDE POWER CYCLE," the entire contents of which are hereby incorporated by reference.

BACKGROUND

The field of the present disclosure is related to supercritical carbon dioxide power cycle systems, apparatuses, and methods for controlling phase changes of CO2.

Supercritical carbon dioxide (sCO2) power cycles have garnered significant attention in recent years as a promising alternative to traditional steam Rankine cycles for power generation. Operating above the critical point of carbon dioxide (CO2), typically around 31.1° C. (87.8° F.) and 7.39 MPa (73 atm) pressure, these cycles offer several advantages, including higher efficiency, compact equipment size, and potentially lower capital costs in comparison with steam Rankine power cycles. In an sCO2 cycle, CO2 is heated and pressurized to supercritical conditions, where it exhibits properties of both a gas and a liquid, enabling efficient energy transfer and power generation in a relatively small footprint.

However, operating an sCO2 power cycle near the critical point of CO2 presents unique challenges. Near the critical point, CO2 undergoes drastic changes in its thermodynamic properties, such as density and specific heat capacity, even with small variations in pressure or temperature. This sensitivity can lead to operational difficulties, particularly in maintaining stable and predictable system behavior. Control and stability become critical concerns, as slight deviations from optimal conditions can significantly impact cycle performance and efficiency.

One of the primary difficulties arises from the narrow range of operating conditions near the critical point. Operating too close to the critical point can result in unpredictable behavior, such as large fluctuations in density and heat transfer coefficients, which can compromise system reliability and performance. Additionally, the potential for the formation of two-phase regions, where both liquid and gas phases coexist, further complicates the operation of equipment such as pumps, compressors, and heat exchangers. Managing these challenges requires advanced control strategies and precise instrumentation to ensure stable and efficient operation.

Furthermore, the design and optimization of components for sCO2 cycles near the critical point demand a thorough understanding of the thermodynamic behavior of CO2 under these conditions, including material compatibility, corrosion resistance, and thermal stresses in response to the unique challenges posed by supercritical operation. Despite these challenges, the potential benefits of sCO2 power cycles, including increased efficiency and reduced environmental impact, continue to drive research and development efforts aimed at overcoming the difficulties associated with operating near the critical point of carbon dioxide.

These difficulties are exacerbated in a system that discharges thermal energy to the ambient atmosphere, especially in geographical locations where the ambient temperature fluctuates above and below the CO2 critical point. It would be advantageous if a sCO2 power cycle could be designed and operated without regard to the fluctuating ambient temperature and would provide a further improvement to provide a system that has repeatable CO2 temperatures that provide a stable inlet temperature to a heat exchanger of a thermal energy source that is sensitive to inlet temperatures. These and other benefits and advantages will become apparent to those of skill in the art by reference to the following description and accompanying drawings.

SUMMARY

The specification and annexed drawings disclose examples of systems, apparatuses, devices, and techniques that may provide for phase control of transcritical $CO_2$ in an $sCO_2$ power cycle without regard for ambient temperature, which can improve the efficiency of the power cycle as well as provide temperature stability for the $CO_2$ for coupling to a thermal energy source that is sensitive to inlet temperatures. In some implementations, this may be accomplished by coupling a refrigeration cycle to the $CO_2$ power cycle, which may include a condenser that condenses the $CO_2$ exiting the turbine before pumping the condensed $CO_2$ to a heat exchanger that thermally couples the $CO_2$ with a coolant loop of a thermal energy source, such as a nuclear reactor.

According to some embodiments, a refrigeration cycle is connected to the carbon dioxide power cycle by replacing the typical carbon dioxide cooler with a condenser which is also the refrigeration cycle evaporator. The heat rejected by the carbon dioxide is absorbed by the refrigerant. Work is done on the refrigerant to raise its temperature above the local ambient temperature. The heat absorbed from the power cycle and the work required to raise the refrigerant temperature is rejected to the ambient environment, either air, earth or water.

In some cases, thermally connecting a condensing carbon dioxide power cycle to the ambient temperature stabilizes the carbon dioxide power cycle operating parameters and ameliorates the influence of the varying properties in the vicinity of the carbon dioxide critical point.

The problem solved is related to the varying physical properties in the vicinity of the critical point of carbon dioxide. Since the critical temperature is between realizable high and low ambient temperatures, the characteristics of the power cycle vary significantly when the ambient temperature rises above or below the critical temperature. The problem solved is to encourage carbon dioxide condensation below the critical point by situating a refrigeration cycle below the carbon dioxide power cycle to maintain stable operating parameters regardless of the ambient temperature.

According to some embodiments, a supercritical carbon dioxide (sCO2) power system includes a thermal energy source; a turbine; a recuperator; a condenser; and a carbon dioxide (CO2) fluid loop configured to convey CO2 through the fluid loop to the thermal energy source, the turbine, the recuperator, and the condenser. In some cases, the sCO2 power system includes a refrigeration system in thermal communication with the CO2 fluid loop at the condenser, wherein the refrigeration loop is configured to remove thermal energy from the CO2 within the condenser and cause a phase change of the CO2 in the condenser.

In some examples, a refrigerant flows through the refrigeration system, and the refrigerant undergoes a phase change as it passes through the condenser. The refrigerant may be provided to the condenser at a temperature that is below an ambient temperature and below the critical temperature of CO2. The refrigerant may be propane, ammonia, or any other suitable refrigerant.

In some instances, the CO2 is in a supercritical state before entering the turbine and in a liquid state upon exiting the condenser. After passing through the turbine, the CO2 may be in a gaseous state.

In some examples, the refrigeration system comprises a compressor, a refrigerant condenser, and an expansion valve. The recuperator may be located and configured to receive hot CO2 from the turbine and transfer heat to cold CO2 after it exits the condenser. The recuperator may thus be provided to provide additional cooling to the hot CO2 and preheat the cold CO2 before it reaches a heat exchanger associated with the thermal energy source.

A generator may be operatively coupled to the turbine and configured to receive kinetic energy from the turbine and use the kinetic energy to generate electricity. For example, the turbine may turn a turbine shaft and the turbine shaft may cause a generator shaft to rotate. In some cases, the turbine shaft and the generator shaft are the same shaft.

A compressor may be operatively coupled to the turbine and/or the generator to receive kinetic energy and compress refrigerant in a refrigeration system.

A CO2 compressor may be operatively coupled to the turbine and/or the generator to receive kinetic energy and compress CO2 within the CO2 fluid loop.

In some cases, a refrigeration system is in thermal communication with the condenser, and the refrigeration system may be configured to provide a heat sink for the CO2 at a temperature below the CO2 critical temperature. In some embodiments, the refrigeration system is configured to be selectively disengaged from the condenser. For instance, where the ambient temperature is below a threshold, the refrigeration system may be deactivated or otherwise thermally decoupled from the condenser.

In some cases, an auxiliary cooling system may be in selective engagement with the condenser and configured to supplant the refrigeration system in response to ambient temperature falling below a threshold. That is, the auxiliary cooling system may selectively operate when the refrigeration system is deactivated or otherwise thermally decoupled from the condenser.

In some instances, the thermal energy source is a nuclear reactor, and the condenser may be configured to supply CO2 at a temperature below an ambient temperature. The condenser may supply CO2 to the nuclear reactor at a temperature that is predetermined and stable. This provides reliability in the inlet temperature to the nuclear reactor.

The system may further include a pump configured to pump liquid CO2 exiting the condenser. A heat exchanger may thermally couple the thermal energy source with the CO2 fluid loop.

According to some embodiments, a method includes the steps of operating a heat generator to raise CO2 to a temperature and pressure above its critical point to a supercritical phase; causing supercritical CO2 (sCO2) to flow through a turbine; operating a refrigeration cycle and causing a refrigerant to flow through a carbon dioxide (CO2) condenser; causing CO2 to flow through the CO2 condenser and condense to a liquid; and pumping the liquid CO2 to the heat generator to cause it to become supercritical.

The method may include the step of providing a refrigerant at a temperature below an ambient temperature and causing a heat exchange between the CO2 and the refrigerant to cause the CO2 to undergo a phase change from a vapor to a liquid.

The method may further include the step of disengaging the refrigeration cycle in response to an ambient temperature falling below a threshold temperature.

According to some embodiments, a method of operating a supercritical carbon dioxide (sCO2) power system includes the steps of heating CO2 in a thermal energy source to a temperature and pressure above a critical point of CO2 to form supercritical CO2 (sCO2); expanding the sCO2 in a turbine to generate mechanical power; cooling the CO2 exiting the turbine in a recuperator; condensing the CO2 in a condenser by transferring heat from the CO2 to a refrigerant in a refrigeration system; and pumping the condensed CO2 back to the thermal energy source.

BRIEF DESCRIPTION OF THE DRAWINGS

The accompanying disclosure and drawings are part of the disclosure and are incorporated into the present specification. The drawings illustrate examples of embodiments of the disclosure and, in conjunction with the description, serve to explain, at least in part, various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein. Like numbers refer to like, but not necessarily the same or identical, elements throughout.

Together with the following description, the drawings demonstrate and explain various principles of the present disclosure. Identical descriptions indicate similar, but not necessarily identical, elements. While the exemplary embodiments shown described herein are susceptible to various modifications and alternative forms, specific embodiments have been shown by way of example in the Drawings and will be described in detail herein, of which.

DETAILED DESCRIPTION OF EMBODIMENTS

Figure 1:
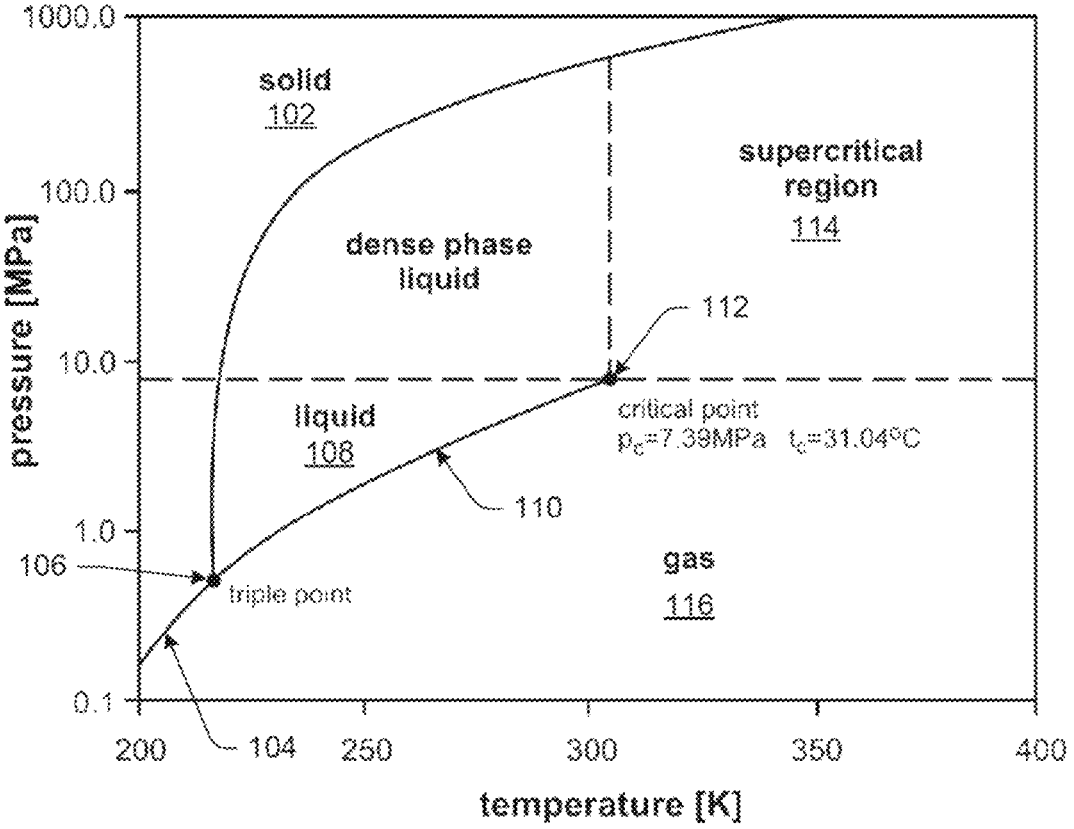
FIG. 1 illustrates a phase diagram of carbon dioxide.

With reference to FIG. 1, a phase diagram of CO2 100 is illustrated. The phase diagram of carbon dioxide is a representation of the equilibrium states of CO2 as a function of temperature and pressure. The phase diagram typically illustrates thermophysical properties of CO2 and delineates several key regions and points:

Solid Phase 102: At low temperatures, CO2 exists in the solid phase, commonly referred to as dry ice. The sublimation curve 104 delineates the boundary between the solid and gas phases. It starts at the triple point 106 and extends to lower temperatures and pressures.

Triple Point 106: At approximately 0.517 MPa (5.1 atm) pressure and −56.6° C. (216.55K) temperature, CO2 exists simultaneously as a solid, liquid, and gas in equilibrium.

Liquid Phase 108: At higher pressures and moderate temperatures, CO2 exists in the liquid phase. The vaporization curve 110 represents the boundary between the liquid and gas phases. It originates from the triple point and extends to higher temperatures and pressures.

Gas Phase 116: At high temperatures and low pressures, CO2 exists as a gas 116. The vaporization curve 110 continues to higher temperatures and pressures, ultimately merging with the critical point.

Critical Point 112: At approximately 7.39 MPa (72.9 atm) pressure and 31.1° C. (304.15° K, 87.8° F.) temperature, CO2 reaches its critical point, beyond which the CO2 is supercritical 114 and distinct liquid and gas phases no longer exist, although the sCO2 exhibits both liquid and gas properties.

Beyond the critical point, CO2 enters the supercritical region 114, where it exhibits properties of both a gas and a liquid. The phase diagram serves as a crucial tool in understanding the behavior of CO2 under various conditions, particularly in applications such as industrial processes, refrigeration, and environmental science. It provides valuable information about phase transitions, critical conditions, and equilibrium states, aiding in the design and analysis of systems involving CO2, such as the described thermal adapter that is especially useful in sCO2 power cycles because the critical temperature of CO2 is 31.1° C. (87.8° F.), and many geographical locations have ambient temperatures that cross this temperature threshold.

Figure 2A:
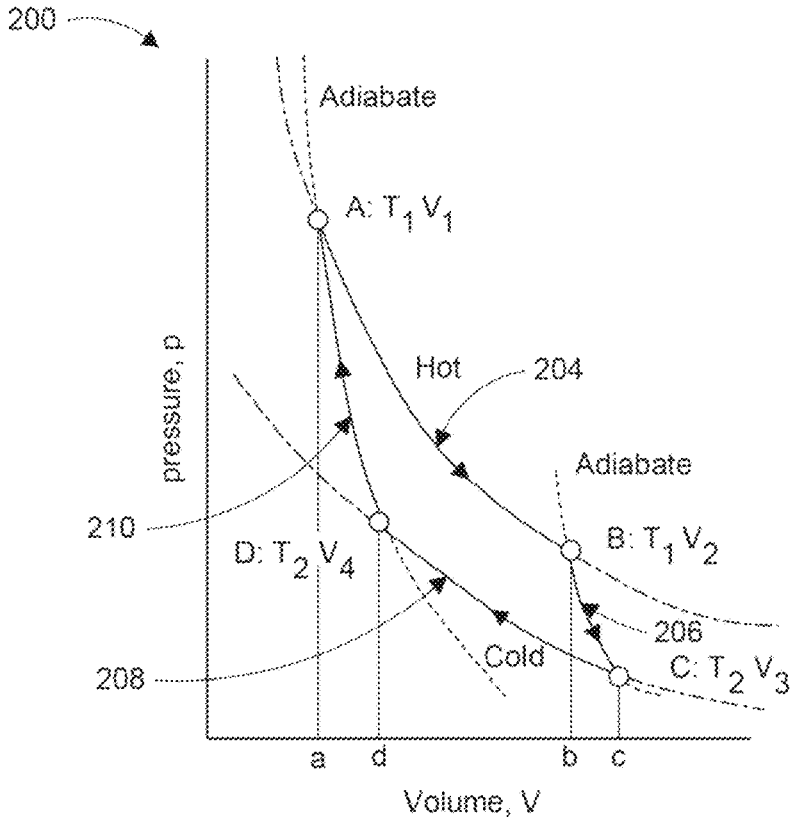
FIGS. 2A and 2B illustrate an idealized Carnot heat engine cycle PV diagram and T-S diagram respectively.
Figure 2B:
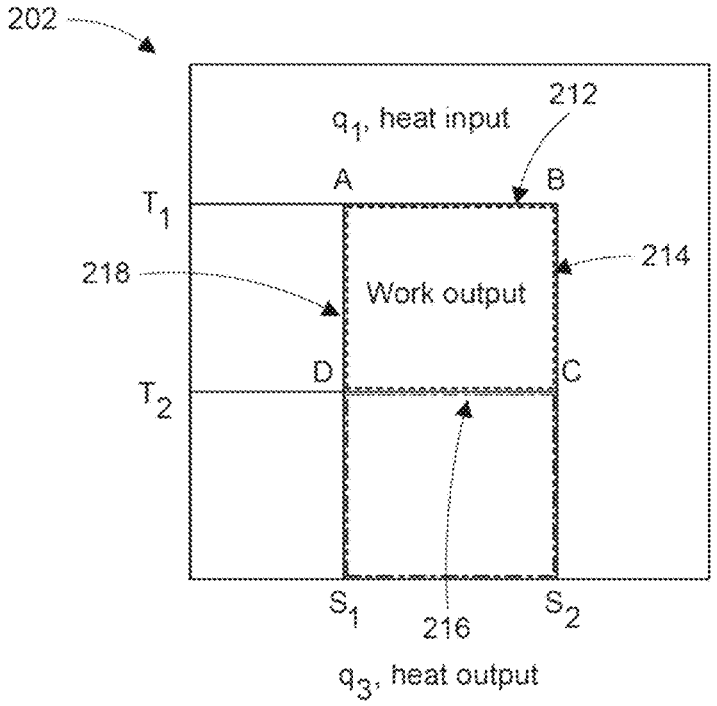

FIGS. 2A and 2B illustrate P-V 200 and T-S 202 diagrams, respectively of an idealized Carnot heat engine cycle. The Carnot cycle is a theoretical thermodynamic cycle that serves as an idealized model for the operation of heat engines. The Carnot cycle consists of four reversible processes:

Isothermal Expansion 204: The working fluid is in contact with a high-temperature reservoir, and heat is absorbed isothermally at a constant temperature $T_H$.

During this process, the gas expands reversibly and performs work on the surroundings. The expansion is typically carried out in a piston-cylinder arrangement.

Adiabatic Expansion 206: After absorbing heat isothermally, the working fluid undergoes adiabatic expansion, during which no heat is exchanged with the surroundings (Q=0). As the gas expands without heat input, its temperature and pressure decrease. This process is reversible and typically involves the rapid expansion of the gas against a piston without heat exchange.

Isothermal Compression 208: The working fluid is in contact with a low-temperature reservoir, and heat is rejected isothermally at a constant temperature Tc. During this process, the gas is compressed reversibly, and work is done on the gas by the surroundings. The compression may be carried out in a piston-cylinder arrangement.

Adiabatic Compression 210: Following isothermal compression, the working fluid undergoes adiabatic compression, during which no heat is exchanged with the surroundings (Q=0). The gas is compressed further without heat exchange, leading to an increase in temperature and pressure. This process is reversible and typically involves the rapid compression of the gas against a piston without heat exchange.

The Carnot cycle T-S diagram illustrates the circular process of temperature versus specific entropy during a thermodynamic process. From the points A to B 212, heat input equals the area of square $ABS_1S_2$. From B to C 214, transferred heat energy (q)=0. From C to D 216, heat output equals the area of square $CS_2S_1D$. Finally, from D to A 218, q=0.

The Carnot cycle is characterized by its maximum theoretical efficiency, which is achieved when operating between two temperature reservoirs. The efficiency, η, of the Carnot cycle is given by the equation:

$$\eta_{CARNOT} = 1 - \frac{T_L}{T_H}$$

Where $T_L$ is the absolute temperature of the cold reservoir and $T_H$ is the absolute temperature of the hot reservoir. Therefore, larger differences between $T_L$ and $T_H$ result in higher efficiencies. The Carnot cycle serves as an ideal benchmark for real-world heat engines, highlighting the fundamental limitations imposed by the laws of thermodynamics. Despite its theoretical nature, the Carnot cycle provides valuable insights into the maximum achievable efficiency for practical heat engine systems.

Through mathematical analysis, it has been shown that the Carnot cycle heat engine coupled to a Carnot refrigerator cycle allows for the low temperature reservoir to be lower than the ambient or ultimate heat sink, and the combined efficiency, especially as the ambient temperature increases, does not exceed the efficiency of the 'bare' Carnot heat engine. This shows that rejecting heat engine cycle low temperature heat to temperatures below ambient does not violate the $2^{nd}$ law of thermodynamics.

In some cases, steam Rankine cycles are the preferred approach of converting heat to power, where the heat is below about 500° C. However, many currently existing and soon to be developed thermal energy sources produce heat above 500° C., such as, for example, nuclear reactors. In some cases, next generation reactors, such as a molten chloride fast reactor (MCFR), generate thermal energy at about 700° C. or higher. While an MCFR may be used as an illustrative thermal energy generator, it should be appreciated that the embodiments shown in the accompanying figures and described herein should not be limited to an MCFR, or to any particular type of nuclear reactor, including other types of fuel, architectures, and thermal energy outputs. For clarity, the described embodiments may be used with any suitable thermal energy source, but is especially advantageous for those thermal energy sources that produce thermal energy above about 500° C., and may include other energy sources that generate heat, such as, without limitation, fossil fuel combustion, oil or natural gas combustion, geothermal energy, solar energy, biofuels, and waste incineration.

In examples where a thermal energy output of a thermal energy generator is greater than about 500° C., steam Rankine cycles are not especially suited to handle temperatures in this temperature range. For example, the upper temperature limits of steam Rankine cycles are primarily constrained by material limitations and practical considerations associated with the components used in power plants, particularly steam turbines and boilers. There are several key factors that contribute to these limits including material strength, material degradation, thermal efficiency, and superheated steam properties.

Steam turbines and boilers typically operate under high temperatures and pressures, which subject materials to significant mechanical stress and thermal loading. The materials used in turbine blades, for example, must possess sufficient strength, creep resistance, and corrosion resistance to withstand these conditions without deformation or failure. At extremely high temperatures, the structural integrity of materials may be compromised, limiting the maximum operating temperature of the cycle.

In addition, high temperatures can accelerate material degradation mechanisms such as oxidation, corrosion, and creep. These processes can reduce the lifespan of components and degrade performance over time. Operating at excessively high temperatures can exacerbate these degradation mechanisms, leading to reduced reliability and increased maintenance costs.

While increasing the temperature of the steam entering the turbine can improve the thermal efficiency of the Rankine cycle by increasing the temperature difference between the heat source and sink, there is a diminishing return on efficiency gains as temperatures rise. This is due to factors such as diminishing returns on Carnot efficiency and increasing losses from irreversibilities such as turbine blade leakage and steam quality.

Finally, at higher temperatures, steam properties such as specific volume and enthalpy change significantly, which can affect the performance and efficiency of turbines and other components. Steam turbines are designed to operate within certain ranges of steam conditions to optimize performance and avoid detrimental effects such as erosion and erosion-corrosion.

Overall, the upper temperature limits of steam Rankine cycles are determined by a combination of material capabilities, operational considerations, and the trade-offs between thermal efficiency and practical constraints. While advances in materials and technology have allowed for higher operating temperatures in modern power plants, there are inherent limitations that must be carefully considered to ensure safe and reliable operation.

One viable alternative to the steam Rankine cycle, especially at higher temperatures, is the gas Brayton cycle. More specifically, a sCO2 Brayton cycle shows significant promise for electricity generation at higher temperatures.

Figure 2C:
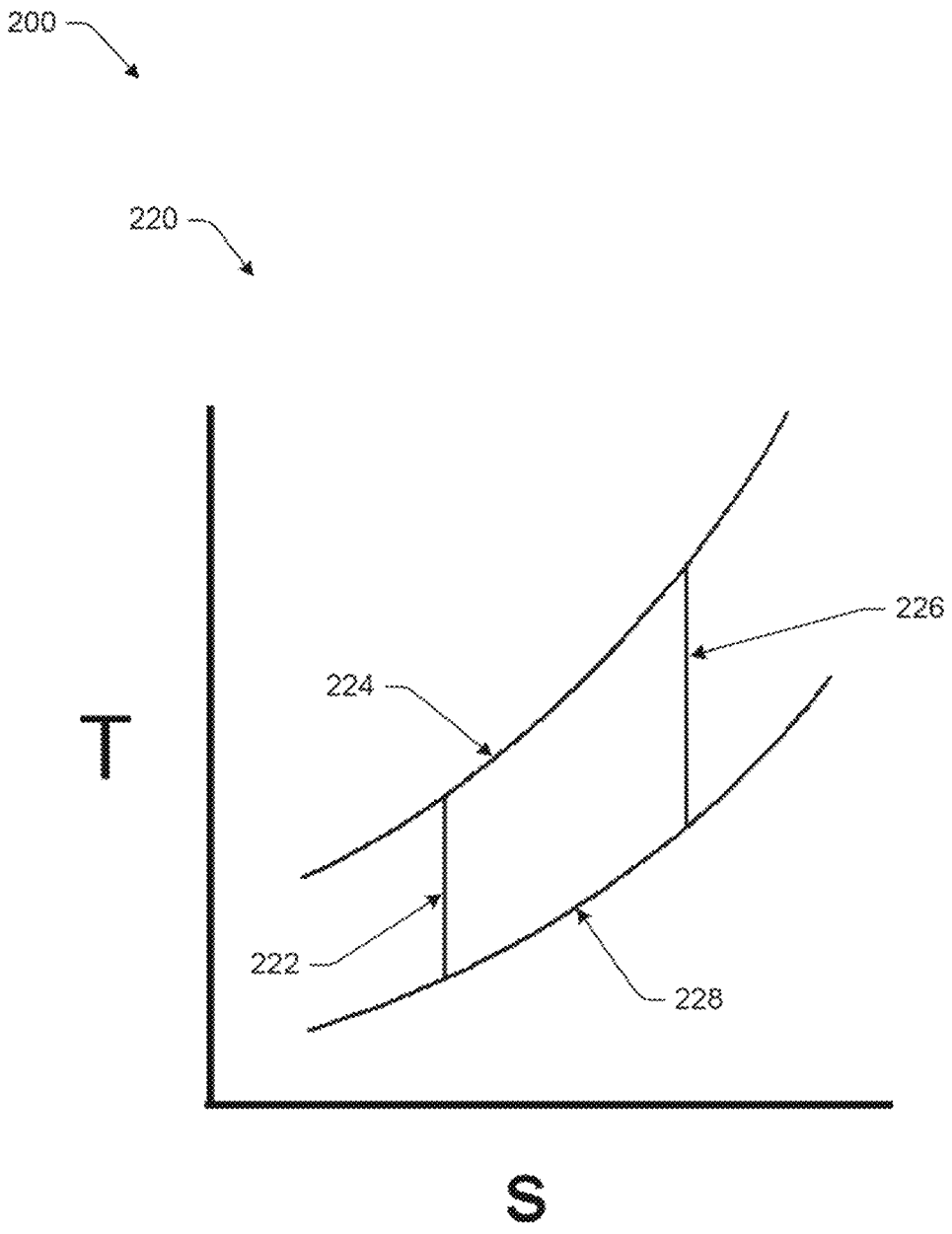
FIG. 2C illustrates a Brayton cycle temperature-entropy (T-S) graph 200.

FIG. 2C illustrates a Brayton cycle temperature-entropy (T-S) graph 220. The area within the T-S curve depicts net work of the cycle. Gases have various working properties, including the gas pressure p, temperature T, mass, and volume V that contains the gas. These variables are related to one another, and the values of these properties determine the state of the gas. A thermodynamic process, such as heating or compressing the gas, changes the values of the state variables in a manner which is described by the laws of thermodynamics. The work done by a gas and the heat transferred to a gas depend on the beginning and ending states of the gas and on the process used to change the state. It is possible to perform a series of processes, in which the state is changed during each process, but the gas eventually returns to its original state. Such a series of processes is called a cycle and forms the basis for understanding the sCO2 Brayton cycle.

The sCO2 Brayton cycle is a thermodynamic power cycle that utilizes carbon dioxide (CO2) operating above its critical point as the working fluid. This cycle offers several advantages over traditional power cycles, including higher efficiency, compact equipment size, and potentially lower capital costs. The Brayton cycle involves four phases including compression, heat addition, expansion, and heat rejection.

The cycle begins with the compression 222 of CO2 from low pressure and temperature to high pressure and temperature. This compression process typically occurs in multiple stages to achieve the desired pressure ratio while minimizing temperature rise and maximizing efficiency. The compression process is typically carried out in a compressor, which may utilize various configurations such as centrifugal or axial compressors.

After compression, the high-pressure supercritical CO2 enters a heat exchanger where it absorbs heat 224 from an external heat source.

In some cases, the heat addition process 224 occurs at approximately constant pressure, allowing the CO2 to undergo an isobaric heat addition process. However, in many cases, the pressure increases with the addition of heat to the CO2. In some cases, the heat source may be a solar receiver, nuclear reactor, waste heat from industrial processes, or any other high-temperature heat source. As used herein, the phrase "high-temperature heat source" and its equivalents is a broad term, and generally refers to any temperature above about 500° C., unless otherwise specified.

The expansion process 226 passes the high-temperature, high-pressure sCO2 through a turbine, converting thermal energy into mechanical work. The expansion process is typically carried out in multiple stages to extract as much work as possible from the CO2 while minimizing the size and cost of the turbine. In many cases, the expansion process is adiabatic and reversible, ideally maximizing the work output from the cycle.

Finally, after expansion, the low-pressure CO2 exits the turbine and enters a heat exchanger where it rejects heat 228 to a low-temperature heat sink.

In some cases, the heat rejection process 228 occurs at approximately constant pressure, allowing the CO2 to undergo an isobaric heat rejection process. According to some embodiments, the heat sink may be a cooling tower, air-cooled heat exchanger, or any other low-temperature heat sink, and in some cases as described herein, is any suitable refrigeration system.

The sCO2 Brayton cycle operates on the principles of thermodynamics, aiming to maximize the efficiency of converting thermal energy into mechanical work. By utilizing CO2 above its critical point, the cycle can achieve high efficiencies and compact equipment sizes compared to traditional power cycles. Additionally, the sCO2 Brayton cycle offers flexibility in terms of heat source and sink options, making it suitable for a wide range of applications including power generation, waste heat recovery, and concentrated solar power.

As described in relation to embodiments herein, where the heat sink is at ambient temperature, there may be complications when the ambient temperature is near, or fluctuates above and below, the critical temperature of CO2. Consequently, according to some embodiments, a refrigeration bottoming cycle causes the CO2 to become transcritical between the turbine expansion and the subsequent compression stage. In this way, while CO2 vapor may exit the turbine discharge, subsequent cooling within the bottoming refrigeration cycle causes the CO2 vapor to condense to a liquid phase, which is more efficient to pump (as compared with compressing CO2 vapor), and transport through the Brayton cycle stages. As used herein, the term "transcritical" refers to causing the CO2 to purposefully change phase from a supercritical phase to a vapor phase, and to a liquid phase, before returning it to its supercritical phase. In this way, the sCO2 power cycle that includes the bottoming refrigeration cycle may be said to cause the CO2 to go around the critical point in a circle on the CO2 phase diagram, rather that hovering near the critical point as in many typical sCO2 power cycles that rely on ambient temperature as a heat sink. As used herein, the term "bottoming cycle" is a broad term and is used to generally refer to a low temperature cycle, in other words, a cycle that is lower than the high temperature cycle. For example, a refrigeration cycle is at a lower temperature than the sCO2 power cycle, and is therefore a bottoming cycle, in part because it causes a decrease in the temperature of the operating fluid below ambient. Similarly, when viewing a T-S diagram, the refrigeration cycle influences the bottom of the T-S curve by causing it to be present at a lower T, and is therefore a bottoming cycle in this regard.

In some embodiments, providing a heat sink having a temperature below the CO2 critical temperature will allow for isothermal heat rejection. In some cases, a high coefficient of performance (COP) refrigeration cycle may be used as a thermal adapter, allowing for CO2 condensation. Some examples of suitable refrigeration cycles include those that use propane or ammonia as refrigerants. Of course, other refrigerants are possible and contemplated herein.

Additional benefits of this configuration include similar sCO2 cycle performance year round without regard for ambient temperature fluctuations. It also allows liquid pumping equipment to be used to pump liquid CO2, which is much more efficient than compressing CO2 vapor and conveying the CO2 vapor in its gaseous phase. Finally, in locations where ambient temperature varies across the critical temperature, there are very different transitions in operation points of the plant, and may even require different equipment, such as replacing a pump with a compressor for a part of the year where the ambient temperature is greater than the CO2 critical temperature. The incorporation of a refrigeration bottoming cycle greatly improves the efficiency and reliability of the sCO2 power cycle.

Figure 3:
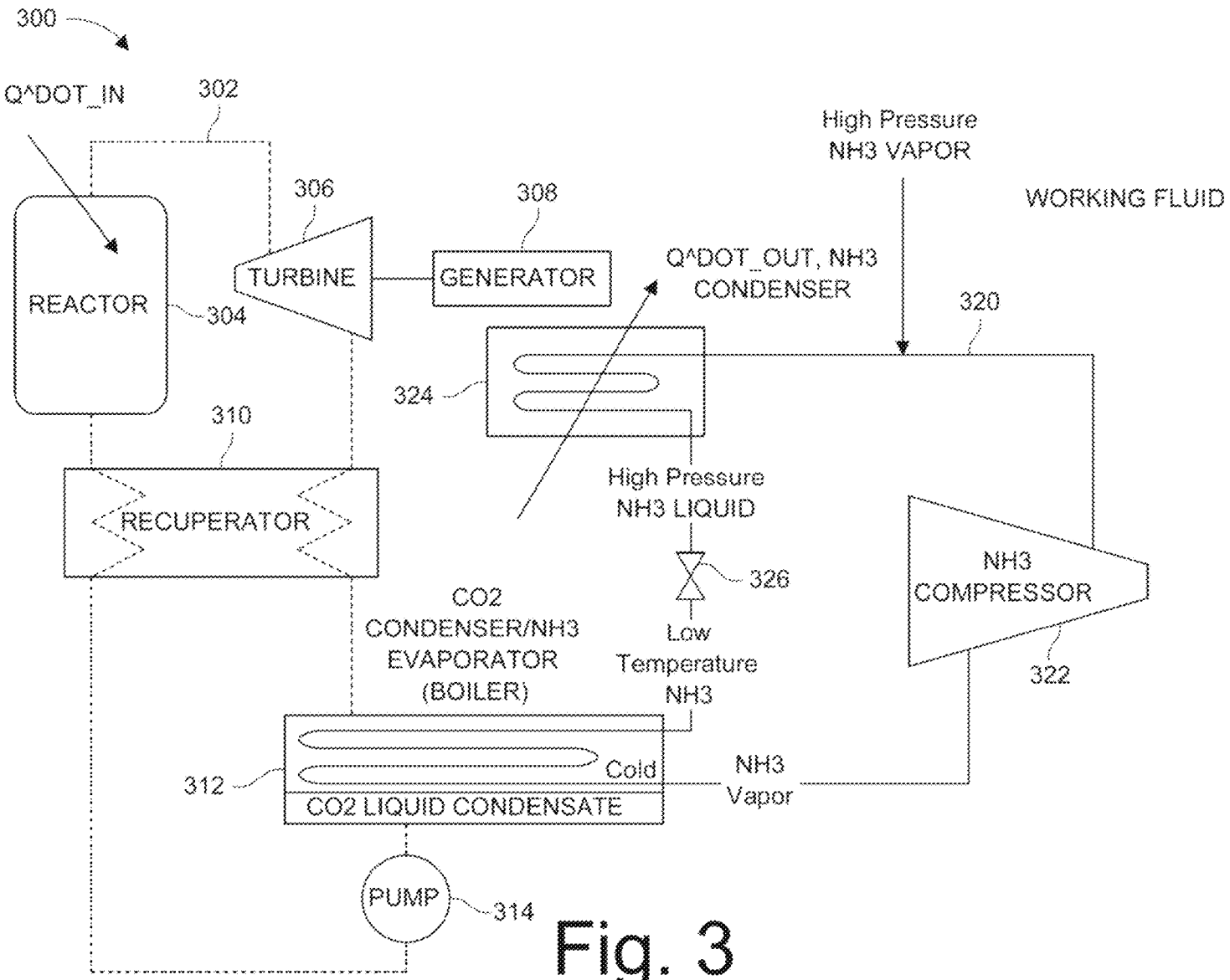
FIG. 3 illustrates, in block diagram form, a power cycle with a refrigeration bottoming cycle, in accordance with some embodiments.

FIG. 3 illustrates a simple sCO2 power cycle with refrigeration bottoming cycle 300. A first loop 302 illustrates the CO2 fluid loop. A heat source 304, such as a nuclear reactor provides thermal energy which is transferred to the CO2 in the CO2 loop 302, such as by a heat exchanger, as is known in the art. The heated CO2, which is in a supercritical state, passes through the turbine 306, where it expands to drive the turbine 306, which in turn, drives a generator 308 to produce electricity. The CO2 leaving the turbine 306 is at a high temperature (as compared with the CO2 temperature at the inlet to the heat source 304) and is passed to a recuperator 310. The recuperator 310, which may include a heat exchanger, allows the high-temperature CO2 to preheat the cold CO2 before it enters the inlet of the heat source 304.

At the recuperator hot side exhaust, the CO2 leaves the recuperator 310 and enters a CO2 condenser 312, which may also be part of the refrigeration cycle (e.g., a boiler), and the CO2 condenses to a liquid phase. The liquid CO2 may be conveyed, such as by a pump 314, to the recuperator 310, where it is preheated by high temperature CO2 exiting the turbine 306, before entering the inlet of the heat source 304.

In many embodiments, the CO2 exiting the recuperator 310 and heading to the heat source 304 passes through a heat exchanger associated with the heat source (not shown) and absorbs heat from the heat source primary coolant and becomes heated before being sent to the turbine 306. Thus, the heat source 304 provides heat transfer, the rate of which is denoted Q^DOT IN, to the CO2 in the first loop 302.

In some embodiments, the heat source 304 may be sensitive to the inlet temperature of its primary coolant, such as is the case with a nuclear reactor. Variations in the CO2 temperature entering the reactor heat exchanger will cause variations in the temperature of the reactor primary coolant, which in turn, cause variations in the thermal hydraulics of the nuclear reactor.

For example, a molten chloride fast reactor (MCFR) is a type of advanced nuclear reactor design that utilizes molten chloride salt as both the coolant and the fuel carrier. The sensitivity of an MCFR to inlet temperature primarily stems from its design and operating characteristics. In an MCFR, the molten chloride salt serves as both the coolant and the heat transfer medium. The reactor core operates at high temperatures, typically in the range of 600° C. to 800° C. or higher. The inlet temperature of the coolant is crucial for maintaining proper thermal hydraulics within the reactor core. Deviations from the designed inlet temperature can affect the flow distribution, heat transfer rates, and reactor performance.

In addition, the inlet temperature of the primary coolant can influence the reactivity and stability of the reactor core. Molten chloride salts have relatively low neutron absorption cross-sections, allowing for efficient neutron moderation and breeding of fissile material. However, changes in coolant temperature can affect the density and composition of the fuel salt, leading to variations in neutron flux and reactivity. Control systems must be designed to compensate for these temperature-induced changes to ensure reactor stability and safe operation.

Consequently, a system that provides a stable inlet temperature for the primary coolant of the heat source 304 can improve safety, stability, and efficiency of the heat source. In some cases, the CO2 condenser 312 can be controlled to provide a consistent and stable outlet temperature of the CO2 condensate exiting therefrom. Consequently, the liquid CO2 entering the nuclear reactor heat exchanger may be supplied at a consistent temperature, which improves stability of the nuclear reactor. In some cases, the CO2 condenser may be controlled to provide a stable exit temperature of the liquid CO2 existing therefrom.

FIG. 3 also shows a refrigeration cycle 320 that may be any suitable type of refrigeration cycle and may utilize any suitable working fluid. In some embodiments, the refrigeration cycle includes ammonia (NH3) as the working fluid.

An NH3 compressor 322 receives NH3 as a low pressure vapor and compresses it to a pressure and temperature above ambient temperature. The NH3 then goes to an NH3 condenser 324 where it condenses to a liquid through heat removal. Once the NH3 condenses, it is at a low temperature and high pressure. After exiting the NH3 condenser 324 it passes through an expansion valve 326, which drops the pressure and temperature. This has a tendency to cause a mixture of vapor and liquid NH3. As the mixed phase NH3 enters the CO2 condenser 312, which is also the NH3 evaporator/boiler 312 in the refrigeration cycle, the hot CO2 impinges on the coils, and the CO2 condenses and the NH3 vaporizes.

The NH3 leaves the NH3 boiler 312 as a vapor at low temperature and returns to the NH3 compressor 322.

In some cases, as the CO2 power cycle varies, the circulating mass of CO2 may be varied, such as by storing it in liquid form. In some cases, liquid CO2 may be stored within the CO2 condenser 312, such as within a tank or sump, and the volume of recirculating CO2 can be varied as desired to vary the circulating mass loading.

In some cases, utilizing vapor condensing and bubble collapse provides benefits to heat transfer efficiencies. In the CO2 condenser, there may be two-phase heat transfer on both sides of the condenser. That is, on a hot side of the CO2 condenser 312, the CO2 transitions from a gas and condenses to a liquid. On the cold side of the CO2 condenser 312, the NH3 transitions from a liquid to a vapor. This mutual two-phase heat transfer allows for compact and efficient equipment compared with equipment used for single phase, or only a single two-phase heat transfer mechanism.

In some cases, the CO2 liquid is cooled to about 15° C. while the NH3 vapor at about 12° C. may be heated in order to provide for an efficient mutual two-phase heat transfer. Of course, other temperatures are contemplated, and the temperatures provided are given by way of example and not limitation. In some embodiments, the CO2 loop is a closed loop, and the mass of CO2 remains approximately constant throughout repeated sCO2 power cycles. Similarly, the refrigeration loop may also be a closed loop, such that refrigerant remains approximately constant with only minimal losses, if at all.

In some cases, as will be explained later herein, the refrigeration loop may be used optionally, such as when the ambient temperature is above a threshold temperature. Appropriate control mechanisms, such as valves, piping, and/or controllers may selectively disengage the refrigeration loop 320 from providing a heat sink for the CO2 loop.

Figure 4:
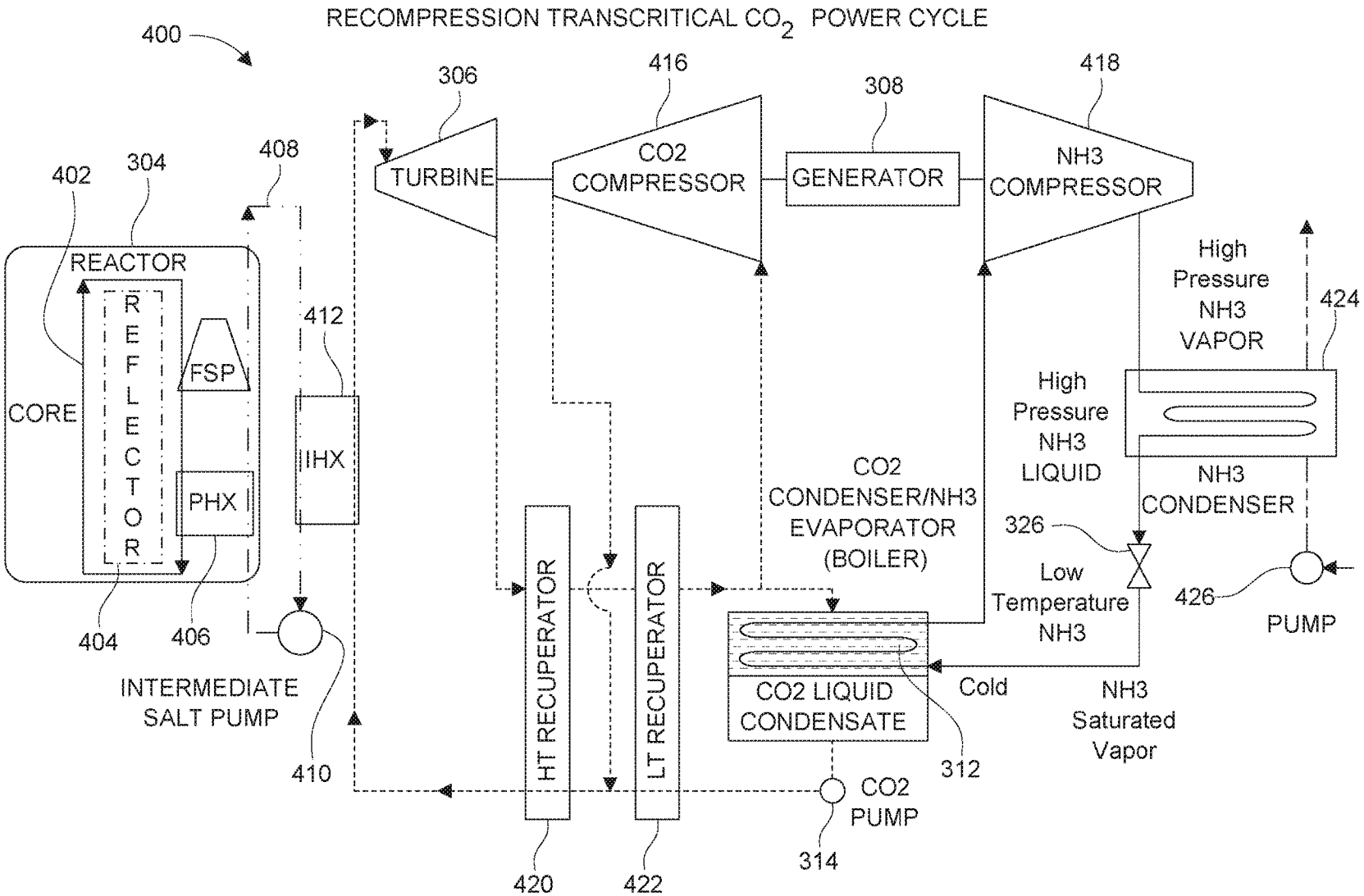
FIG. 4 illustrates, in block diagram form, a recompression transcritical CO2 power cycle, in accordance with some embodiments.

FIG. 4 illustrates, in block diagram form, a recompression transcritical CO2 power cycle 400. A heat source 304, which may be a nuclear reactor, circulates a primary coolant in a primary coolant loop 402. The primary coolant loop 402 passes through a nuclear reactor core 404 and to a primary heat exchanger 406. The primary coolant may be any suitable coolant, such as, without limitation, a metal, water, a fuel salt, a coolant salt, heavy water, air, carbon dioxide, helium, liquid sodium, a sodium-potassium alloy, among others. The primary heat exchanger 406 transfers thermal energy from the primary coolant to an intermediate coolant loop 408 carrying an intermediate coolant. In some cases, the intermediate coolant may be any suitable coolant, and in some cases, is salt. The intermediate coolant loop 408 may be circulated by a pump 410 through the primary heat exchanger 406 and through an intermediate heat exchanger 412. The intermediate heat exchanger 412 may receive the intermediate hot coolant at a first working fluid inlet, and may also receive cold CO2 in a second working fluid inlet. The intermediate heat exchanger 412 may be any suitable type of heat exchanger, such as a shell and tube, a plate heat exchanger, double pipe heat exchangers, spiral heat exchanger, or any other suitable heat exchanger or combination of heat exchangers that are configured to transmit thermal energy from the intermediate coolant to the CO2.

The foregoing description of a heat source that heats primary coolant, a primary heat exchanger, an intermediate coolant loop and an intermediate heat exchanger may be utilized with any of the embodiments shown and described herein. Where an embodiment does not specifically describe a primary coolant loop and an intermediate coolant loop does not signify that these coolant loops do not exist, but rather, the specific architecture of heat transfer from the heat source ultimately to the CO2 may be omitted for sake of brevity.

A CO2 loop may include piping that routes CO2 to the intermediate heat exchanger 412 where it receives thermal energy from the intermediate coolant. The thermal energy may cause the CO2 to become supercritical by imparting heat and/or pressure to the CO2 to cause it to enter the supercritical phase. The sCO2 may enter a turbine 306, where it expands and imparts kinetic energy to the turbine 306. The turbine 306 may in turn drive a generator 308 to generate electricity. In some cases, the kinetic energy from the turbine 306 may also drive other components, such as a CO2 compressor 416, and/or a refrigerant compressor 418, which may be an NH3 compressor 418.

After leaving the turbine 306, the CO2 may be supercritical, in gaseous form, or a combination of phases where it is routed to a high-temperature recuperator 420. The high-temperature recuperator 420 is situated to transmit thermal energy from the high-temperature CO2 exiting the turbine 306 to pre-heat the liquid CO2 exiting a CO2 condenser 424.

Optionally, the pre-heating of the liquid CO2 may further be accomplished with a low-temperature recuperator 422. As used in reference to the recuperator, the terms high-temperature and low-temperature are used relative to each other. That is, as hot CO2 exits the turbine, it is cooled from its peak temperature by the high-temperature recuperator, at which point, the CO2 cools and enters the low-temperature recuperator where additional thermal energy is withdrawn from the CO2. The two-stage recuperator 420, 422 provides for increased thermal energy transfer as compared to a single recuperator. In some cases, the recuperators 420, 422 will cause the CO2 to have a reduced temperature as compared with CO2 exiting the turbine 306, which allows a higher efficiency at the CO2 condenser 312.

In some embodiments, after passing through a single recuperator, or a high-temperature recuperator 420 and/or a low-temperature recuperator 422, the stream of CO2 may be bifurcated, and a first portion of the CO2 may be sent to the CO2 condenser 312 while a second portion of CO2 may be sent to a CO2 compressor 416. The CO2 condenser may operate as described with any embodiment herein, and may function to condense the CO2 into a liquid phase which may then be pumped, such as by a CO2 pump 314 back through the low-temperature recuperator 422 and the high-temperature recuperator 420 to withdrawn thermal energy from the hotter CO2 coming from the turbine 306. In some cases, the recuperator is optional and may not be present in every instance.

The portion of CO2 that is routed to the CO2 compressor 416 may be compressed, which increases its pressure and temperature, and in some cases, is sufficient for the second portion of CO2 to be in a liquid phase, or a dense gas phase, which may then be mixed with the liquid CO2 exiting the CO2 condenser 312 after having its pressure risen by going through the CO2 pump 314.

As previously described, a refrigeration circuit may be provided to cooperate with the CO2 condenser 312 to cause a temperature change, and/or a phase change to the CO2. In some examples, NH3 is used as the refrigerant as an example, and it should be apparent that other refrigerants are suitable and contemplated for use in a suitable refrigeration cycle, such as, for example, propane, water, CO2, any of a number of hydrocarbons (HCs), fluorocarbons (FCs), chlorofluorocarbons (CFCs), hydrofluorocarbons (HFCs), hydrochlorofluorocarbons (HCFCs), or any other suitable refrigerant or combinations of refrigerants.

The refrigerant, which may be NH3 in the illustrated embodiment, leaves the CO2 condenser 312, which also functions as the NH3 boiler, as hot vapor and is transported to the NH3 compressor 418, where the NH3 is compressed to a high pressure and temperature. The high temperature and pressure NH3 may optionally pass through an NH3 condenser 424, which may transfer heat from the NH3 to any suitable working fluid. In the illustrated embodiment, seawater may be used as the working fluid for cooling and condensing the NH3. Of course, any suitable coolant may be used, such as, without limitation, ambient air, fresh water (e.g., river water or lake water), CO2, or any other suitable working fluid.

In some embodiments, a pump 426 may circulate the refrigerant working fluid through the NH3 condenser 424 which may receive high pressure NH3 vapor, which is then condensed to a high-pressure liquid before exiting the NH3 condenser 424. The high-pressure liquid NH3 may then pass through an expansion valve 326 and exit the expansion valve 326 as low temperature liquid NH3, or a saturated NH3 vapor, or a combination of phases before entering the CO2 condenser 312.

Figure 5:
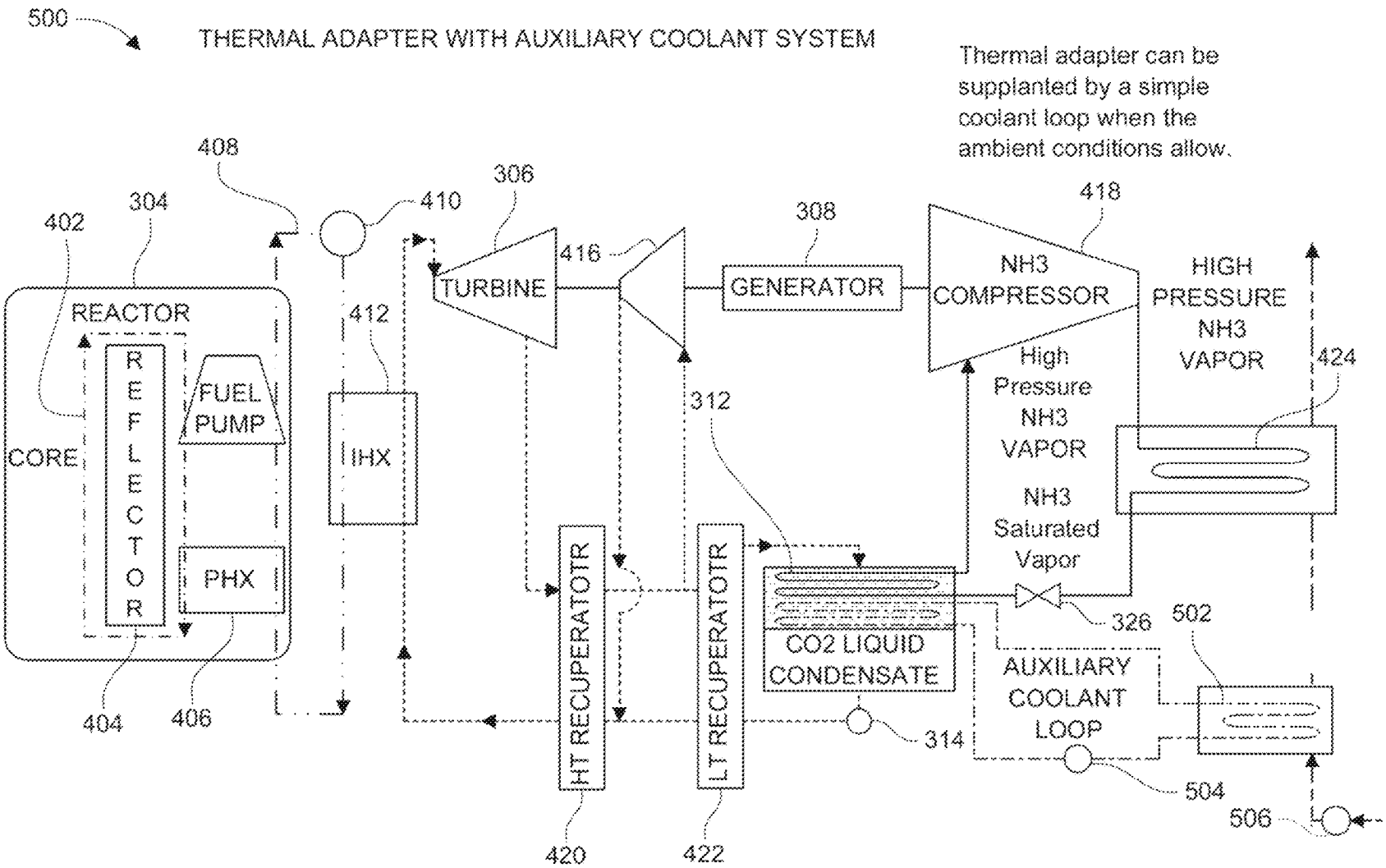
FIG. 5 illustrates a thermal adapter with an auxiliary coolant system, in accordance with some embodiments.

FIG. 5 illustrates a thermal adapter with an auxiliary coolant system 500. The embodiments shown in FIG. 5 are similar to those illustrated in FIG. 4, where like numbers refer to like elements; however, FIG. 5 further illustrates an optional auxiliary coolant system. In some cases, the closed-loop refrigeration cycle, which is illustrated as an example NH3 system in the illustrated embodiments, may be selectively supplanted by an auxiliary cooler. For instance, in some cases, the NH3 refrigeration cycle may be turned off, disconnected, or otherwise deactivated, as desired. The NH3 refrigeration cycle may be deactivated depending on ambient temperature and/or the presence of an alternative coolant. In some cases, when the ambient temperature drops below a threshold temperature, the NH3 cooling cycle may be turned off, or otherwise decoupled from the thermal adapter. For instance, when the ambient temperature drops below a threshold value below the critical temperature of CO2, the thermal adapter may not need to rely on the refrigeration cycle in order to condense the CO2 in the CO2 condenser 312. In some cases, the threshold value may be 5° C., or 10° C., or 15° C., or 20° C. In some cases, an automated system includes a temperature gauge and a controller that can disengage the NH3 refrigeration cycle and engage the auxiliary coolant system. In some cases, there is overlap in the operation of the NH3 cycle with the auxiliary coolant system, such as where the ambient temperature is below a first threshold temperature and above a second threshold temperature. In an example, as the ambient temperature reduces to equal the critical temperature of CO2, the auxiliary coolant system may engage, while the NH3 refrigeration loop is still active. As the ambient temperature continues to reduce to the second threshold, the auxiliary cooling system may take the cooling load away from the NH3 refrigeration cycle and the NH3 refrigeration cycle may be fully disengaged.

The auxiliary cooling system may be any suitable cooling system, and in some cases, may be a closed fluid loop having an auxiliary working fluid. In some cases, the auxiliary working fluid may be water. The auxiliary working fluid may circulate between an auxiliary cooler 502 and the CO2 condenser 312, such as by a pump 504, or compressor in the case of a gaseous auxiliary working fluid. In some cases, the auxiliary working fluid may flow through an open fluidic system, such as water (e.g., sea water, river water, lake water, etc.) through the CO2 condenser 312 and back to its source. In some examples, a gas is caused to flow through the auxiliary cooler. The gas may be air. In other cases, the auxiliary cooling system defines a closed loop, where the auxiliary working fluid flows through the CO2 condenser 312 and back to the auxiliary cooler 502. In some cases, the auxiliary cooler 502 transfers heat from the auxiliary working fluid, to a naturally occurring coolant, such as seawater, river water, lake water, air, or some other naturally occurring medium that can be used to cool the auxiliary working fluid. A pump 506 may cause the naturally occurring coolant to flow through the auxiliary cooler 502, the NH3 condenser 424, or both depending on the operational configuration of the auxiliary cooling system.

In this way, ambient conditions may be utilized within the thermal adapter 500 to cool and condense the CO2.

Figure 6:
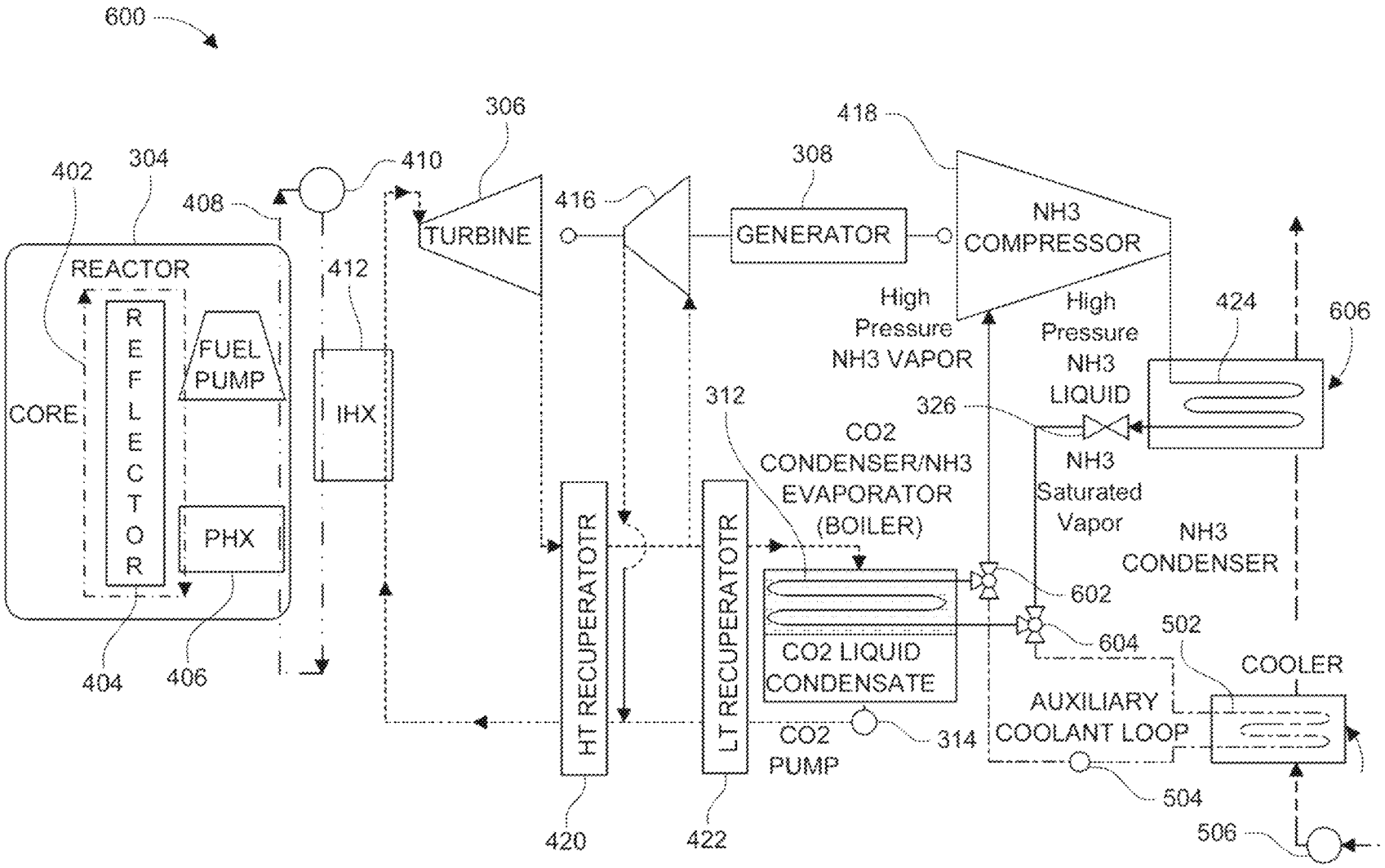
FIG. 6 illustrates a thermal adapter with auxiliary coolant system with a cutout option, in accordance with some embodiments.

FIG. 6 illustrates a thermal adapter with an auxiliary coolant system having a cutout option 600. The embodiments shown in FIG. 6 share substantial overlap and description with the embodiments shown in FIG. 5. However, one notable difference is the inclusion of one or more valves 602, 604 that allow the refrigeration cycle 606 or the auxiliary cooling cycle 608 to provide coolant to the CO2 condenser 312.

Depending on the ambient temperature at the time the system 600 is operated, either the refrigeration cycle 606 or the auxiliary cooling cycle 608 may be operated to provide cooling to the CO2 condenser 312. For example, where the ambient temperature is near, or above, the critical temperature of CO2, the refrigeration cycle 606 may be operated to providing a bottoming cycle for the CO2 at the CO2 condenser 312 to provide a low temperature heat sink that will remove heat from the CO2 at the CO2 condenser 312 and cause the CO2 vapor to condense into a liquid. However, where the ambient temperature is near or below the critical temperature of CO2, a first valve 602 may be configured to disconnect the refrigeration cycle 606 from the CO2 condenser 312, and a second valve 604 may be configured to fluidically couple the auxiliary cooling system 608 with the CO2 condenser 312. In this way, the refrigeration system 606 and the auxiliary cooling system 608 may be selectively in fluid communication with the CO2 condenser 312 and be in selective thermal communication with the sCO2 power system.

The refrigeration cycle 606 and the auxiliary cooling system 608 may operate as described elsewhere herein. For instance, the refrigeration cycle 606 may use any suitable refrigerant and equipment to provide a low temperature heat sink for the CO2 vapor at the CO2 condenser 312. Similarly, the auxiliary cooling cycle 608 may utilize any suitable coolant, and may use naturally occurring coolant sources, such as ambient air, sea water, river water, lake water, district water, or some other suitable source.

There are several benefits to a refrigeration loop used as a bottoming cycle in a sCO2 power cycles, as described throughout the various embodiments herein, as compared with sCO2 power cycles that do not rely on a refrigeration bottoming cycle. Some of the benefits include stable, fixed operating conditions for the heat source. No stability issues arising from working within temperatures and pressures that are in proximity to the critical point of CO2. A liquid pump for pumping the condensed CO2 is small and more efficient than a compressor required to compress CO2 gas. A condensing heat transfer in the CO2 condenser is more efficient that a gas-to-gas heat exchanger. As described herein, a phase change heat transfer system is more efficient than a single-phase heat transfer system, and in some cases, the described embodiments utilize a two-phase heat transfer on both sides of the CO2 condenser. In addition to increased efficiency, a condensing heat exchanger at lower temperatures can utilize smaller equipment and cheaper materials.

Additional benefits include a simple Rankine/Brayton cycle is likely easier to operate because it only requires a pump and a turbine, although adding the recompression cycle with an additional compressor increases overall efficiency. By controlling a fixed temperature of heat rejection, the thermal adapter can be designed and configured for the particular needs of the system, such as whether the system is used for district cooling and heating, process heating, and can be based on historical ambient conditions and demands. In some cases, the performance of a nuclear thermal plant can be independent of ambient conditions. For instance, the thermal adapter can absorb fixed rejected heat from the nuclear thermal plant and reject heat to an ultimate heat sink at local ambient conditions as seasons and temperatures change.

In addition, a lower average temperature of heat rejection improves the cycle thermal efficiency. By reducing the number of gas-to-gas heat exchangers, the cost and footprint of the equipment requirements are reduced. Higher specific work reduces the mass flow requirements for a given output. As described, the mass flow of the CO2 can be tuned for the particular operating parameters, as desired. The working fluid inventory control may be accomplished by storing CO2 in liquid form, such as in a hotwell within the CO2 condenser. Finally, the described embodiments have lower transient thermal stresses in the recuperator compact heat exchangers, due at least in part to the fixed temperatures provided by the architecture and arrangement of the equipment.

Figure 7:
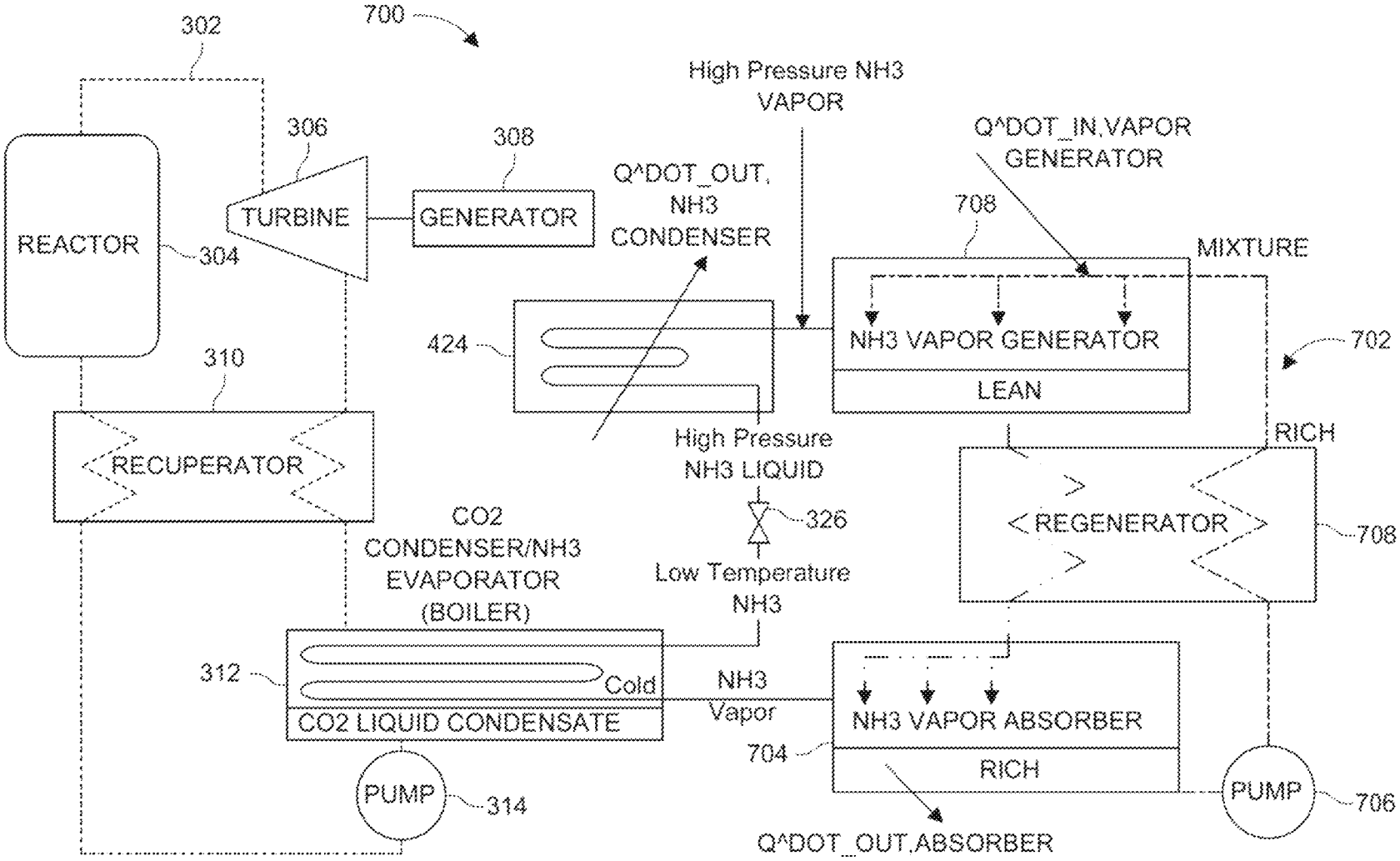
FIG. 7 illustrates an alternative embodiment of a thermal adapter with an alternative refrigeration configuration, in accordance with some embodiments.

FIG. 7 illustrates an alternative embodiment of the thermal adapter with an alternative refrigeration configuration 700. A heat source, such as a nuclear reactor 304 provides thermal energy that is transferred to a turbine 306, which is coupled to a generator 308 for generating electricity. The heat source may be any heat source as described in other embodiments, and the thermal energy transfer may be similar or the same as described in relation to other embodiments herein, and for brevity, will not be described in great detail in relation to FIG. 7. A CO2 fluid loop 302 conveys supercritical CO2 that has been heated from the reactor generated heat and expands through the turbine 306. After passing through the turbine 306, the CO2, which may be in a supercritical phase, a gas phase, or a combination of phases, enters the recuperator 310 hot side where it is further cooled by lower temperature CO2 passing through the cold side of the recuperator 310 and headed to the reactor 304.

After being cooled by the recuperator 310, the CO2 enters the hot side of the CO2 condenser 312, where it is further cooled and condenses to a liquid condensate. The liquid CO2 then exits the CO2 condenser 312 as a liquid and is pumped, by a liquid pump 314, to the cold side of the recuperator 310 and ultimately to be heated by the heat source 304.

The refrigeration system 702 in the illustrated embodiment may be an absorption chiller. In the illustrated example, the absorption chiller uses ammonia and water, which operates on the principle of absorption refrigeration—a thermodynamic process that utilizes the affinity of certain substances to absorb and release refrigerants. In the illustrated examples, the refrigerant is ammonia (NH3), and the absorbent is water (H2O).

The absorption chiller includes two primary cycles: the refrigeration cycle and the absorption cycle. In the absorption cycle, the ammonia vapor from the refrigeration cycle is absorbed into a solution of water in the NH3 vapor absorber 704, forming a dilute ammonia-water solution. This absorption process occurs in the NH3 vapor absorber 704, a vessel where the weak solution comes into contact with the ammonia vapor. The ammonia vapor dissolves into the water due to their chemical affinity, forming a stronger solution.

The ammonia-water solution may then be pumped, by a liquid pump 706 to a regenerator 708, where it enters the cold side of the regenerator and is pre-heated by NH3 vapor on the hot side of the regenerator 708.

The pump also causes the weak solution containing dissolved ammonia to increase in pressure to a higher pressure and is sent to the generator 710. In the generator, the weak solution is heated, typically using a heat source such as natural gas, steam, waste heat, or excess heat from the heat source 304. As the solution heats up, the ammonia is driven off as vapor from the solution.

The ammonia vapor, now at a higher pressure and temperature, is separated from the remaining water solution. The ammonia vapor is then condensed back into a liquid using an NH3 condenser 424.

The high-pressure, high-temperature ammonia liquid from the NH3 condenser 424 is throttled through an expansion valve 326 valve, reducing its pressure and temperature. The low-pressure liquid ammonia enters the evaporator (e.g., the CO2 condenser 312), where it absorbs heat from the hot CO2 entering the CO2 condenser 312. As the ammonia evaporates, it absorbs heat, causing the CO2 to cool down.

The evaporated ammonia vapor is then drawn into the NH3 vapor absorber 707, where it is absorbed into the weak solution, completing the refrigeration cycle.

In some cases, the absorption chiller 702 operates continuously, with the absorption and generation cycles working in tandem to maintain the desired cooling effect on the CO2. Heat input is required to drive the absorption process in the generator, while cooling is provided by the evaporation of the refrigerant in the evaporator.

This illustrates just another example of a refrigeration cycle as a bottoming cycle on the sCO2 power cycle to cause the CO2 to be transcritical without regard to the ambient temperature, thus resulting in a stable and repeatable sCO2 power cycle, especially in cases where the heat source may be sensitive to inlet temperatures caused by the low temperature CO2 that is heated by the heat source.

As with many of the embodiments described herein, systems and methods are shown and described that reduce the heat sink temperature of the CO2 to below the critical temperature of CO2, which in some cases, allows for isothermal heat rejection. While a net Carnot efficiency may be reduced, in some cases, the $2^{nd}$ law of thermodynamics efficiency may improve thus resulting in a higher overall efficiency of the system. In some cases, a high coefficient of performance refrigeration cycle, such as a propane cycle, may be selected to act as a thermal adapter to provide for CO2 condensation. This further allows for higher efficiency in an ambient temperature range above 30° C., and may additionally provide improved efficiency at lower ambient temperatures as well. The described embodiments further insulate the power cycle and heat transfer from ambient conditions. In other words, the sCO2 power cycle and heat transfer from the heat source maintain stable operating conditions without regard to the ambient temperature, because the refrigeration bottoming cycle can be used to control the temperature of the condensed CO2 that is sent to the heat source. Further, the systems described herein allow for better heat transfer due to phase change materials in heat exchangers, as opposed to heat exchangers that do not utilize phase change materials on one or both sides of the heat exchanger.

As used herein, a heat exchanger typically has a cold side and a hot side and thermal energy is transferred from a working fluid flowing on the hot side to a working fluid flowing on the cold side. Thus, referring to "both sides" of the heat exchanger relates to the hot side and the cold side of the heat exchanger.

Figure 8:
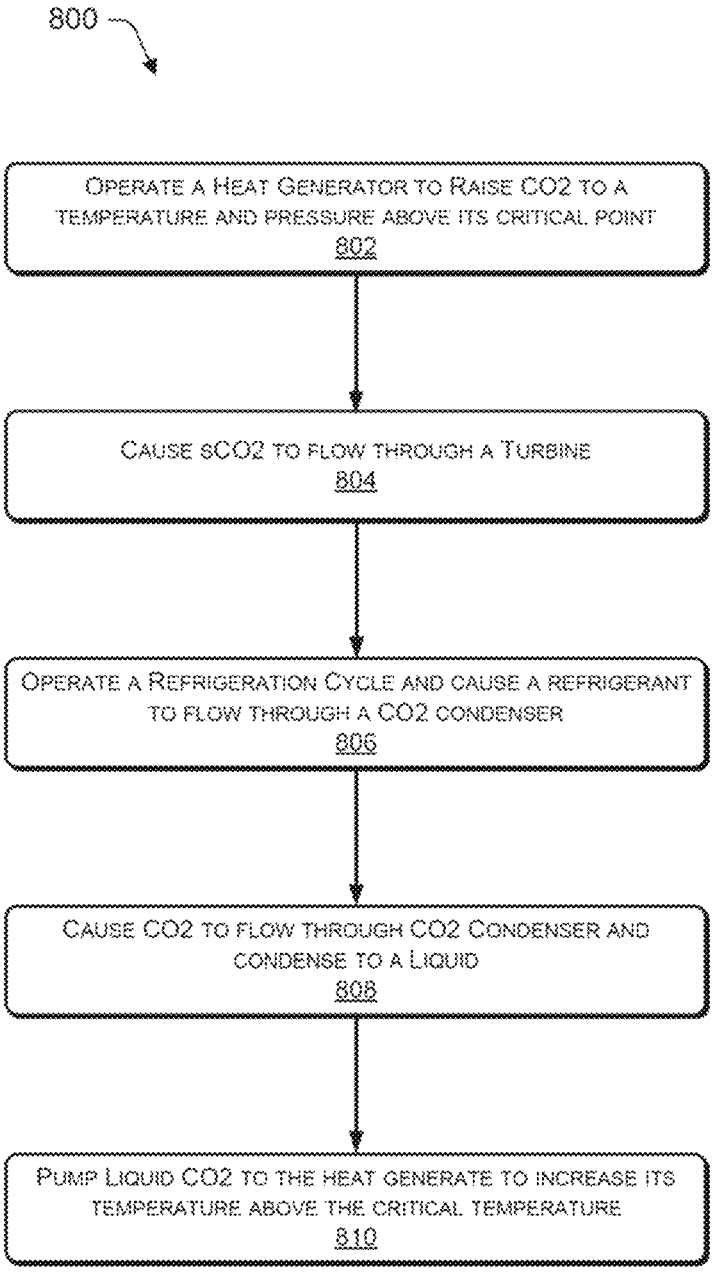
FIG. 8 illustrates a process flow for operating a transcritical sCO2 power cycle.

FIG. 8 illustrates a process flow 800 for operating an sCO2 power cycle with a refrigeration cycle, in accordance with some embodiments. At block 802, a heat generator provides heat that is transferred to CO2 to cause the CO2 to increase in temperature above its critical point. In some cases, the added heat further increases the pressure of the CO2 above its critical point. However, it should be appreciated that the CO2 may alternatively be pressurized above its critical point even before heat is added. In either case, the CO2 is caused to be in a supercritical state where both pressure and temperature are above the critical point.

At block 804, the sCO2 is caused to flow through a turbine, which causes the turbine to rotate and also causes the sCO2 to expand and decrease in pressure. In some cases, the decrease in pressure from expanding through the turbine causes the CO2 to enter a gaseous state in which the pressure is below the critical point. In some cases, causing the turbine to rotate may also cause a generator to rotate and generate electricity.

At block 806, a refrigeration cycle is operated which causes a refrigerant to flow through a CO2 condenser. As discussed herein, the refrigeration cycle may be any suitable refrigeration cycle and the refrigerant may be any suitable refrigerant. As used herein, a refrigeration cycle is one that uses an expansion valve to quickly reduce the pressure, and hence the temperature, of a refrigerant flowing through the refrigeration cycle. In many cases, the refrigerant in a refrigeration cycle undergoes a phase change as it changes from high temperature and high pressure to a lower temperature and a lower pressure.

At bock 808, CO2 is caused to flow through the hot side of a CO2 condenser, where it is cooled by the refrigerant flowing through the cold side of the CO2 condenser. In some cases, the CO2 condenser of the sCO2 power cycle also functions as an evaporator of the refrigeration cycle. In some cases, the CO2 condenser causes a two-phase heat transfer on both the hot side and the cold side of the CO2 condenser. In other words, the CO2 on the hot side of the condenser changes phase from a gas phase to a liquid phase (e.g., condenses). In some cases, the refrigerant on the cold side of the CO2 condenser changes phase from a liquid phase to a vapor phase (e.g., evaporates or boils) during the heat transfer.

At block 810, the condensed liquid CO2 is pumped to the heat generator where the sCO2 cycle starts again with the CO2 becoming heated and pressurized so that it enters the supercritical state.

In some embodiments, the refrigeration cycle is selectively activated or deactivated, which may be based upon the ambient temperature. In some cases, the refrigeration cycle is operated to reduce the CO2 below its critical temperature. The refrigeration cycle thus provides a heat sink below the critical temperature of the CO2 to cause gaseous CO2 to condense into a liquid without regard to the ambient temperature.

FIGS. 9A-9D illustrate model performance of a system utilizing the thermal adapter on an sCO2 Brayton power cycle as compared with a system without the thermal adapter. The models assume that molten salt is used as an intermediate coolant to provide cooling to the heat source and providing heat to the CO2 in the Brayton power cycle. Specifically, FIG. 9A graphs the salt temperature at an inlet to a thermal energy source. As can be seen, the model with the adapter has a very constant inlet temperature as compared to the model without the adapter with varying ambient temperature. That is, in some configurations, CO2 entering the Salt-CO2 heat exchanger maintains a constant temperature allowing for predictable operation of the nuclear salt loop. As a consequence, heat duty removed from the slat remains essentially constant irrespective of ambient temperature conditions. As one would expect, as the ambient temperature varies, the inlet temperature of the coolant will vary dramatically as the heat that is rejected to ambient varies proportionally with ambient temperature.

Figure 9B:
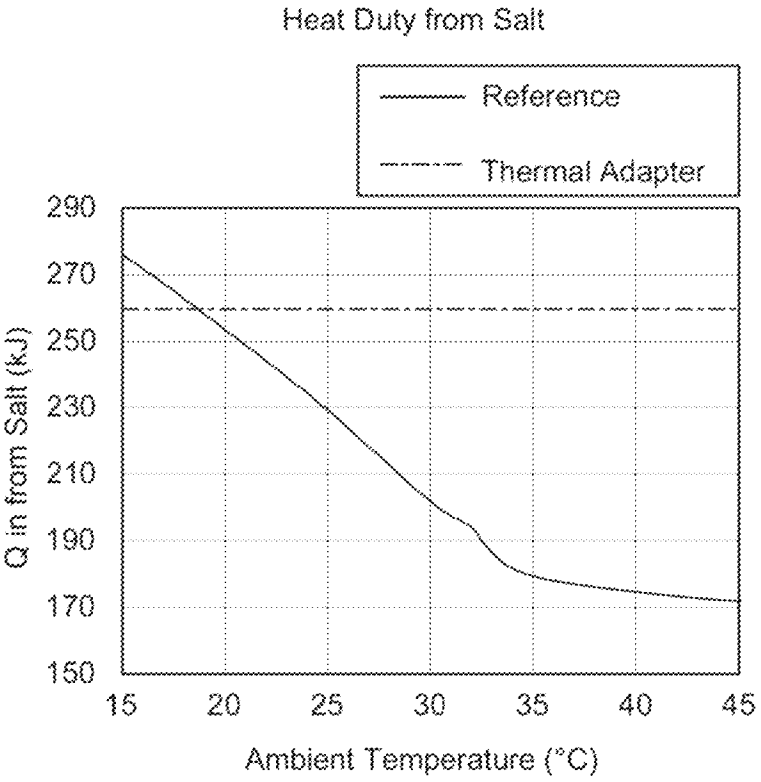
FIGS. 9A-9D illustrate model performance of a system utilizing the thermal adapter on an sCO2 Brayton power cycle as compared with a system without the thermal adapter in terms of inlet temperature to heat source, heat duty, efficiency, and specific work, respectively, in accordance with some embodiments.
Figure 9A:
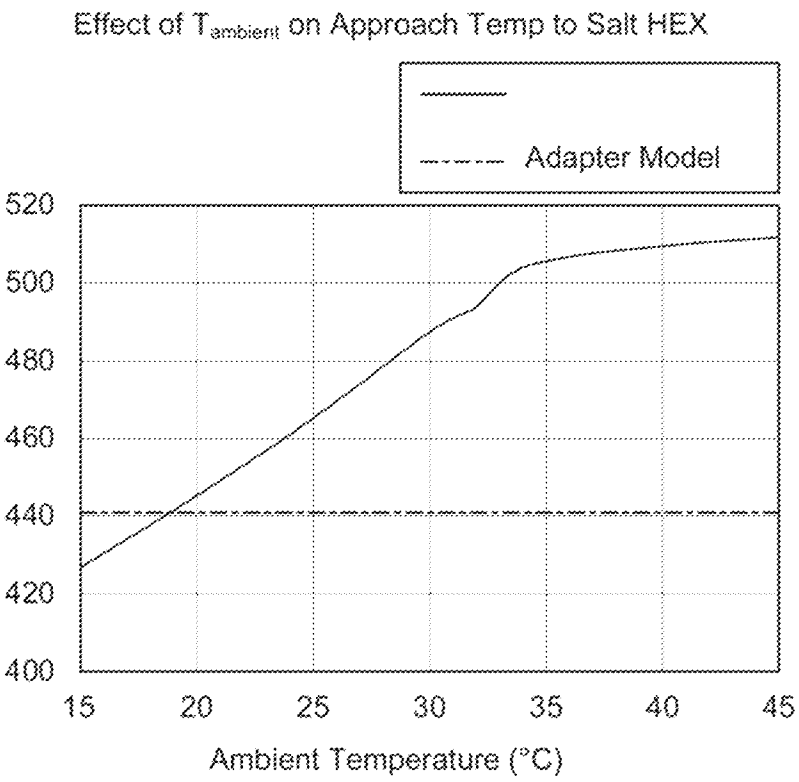

Similarly, FIG. 9B illustrates the heat duty from the coolant. In terms of Q in from the salt, as the ambient temperature increases, the heat duty in the reference model degrades significantly. In contrast, the thermal adapter allows the salt heat duty to remain constant without regard to the ambient temperature. This is in large part due to the controlled temperature difference between the CO2 and the salt remaining high even as ambient temperatures increase. The thermal adapter allows the CO2 to be cooled much more effectively, especially as ambient temperatures increase.

Figure 9D:
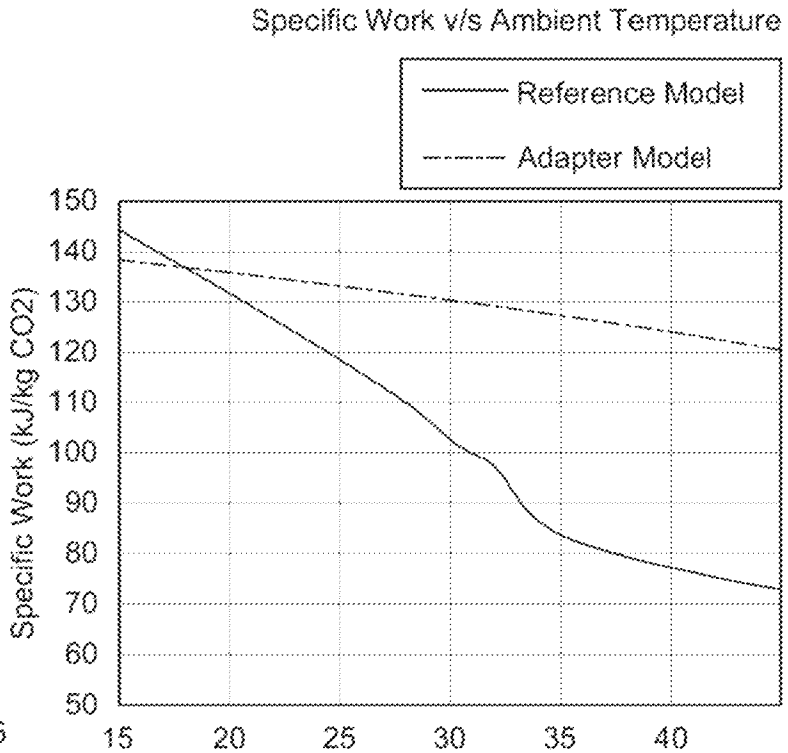
Figure 9C:
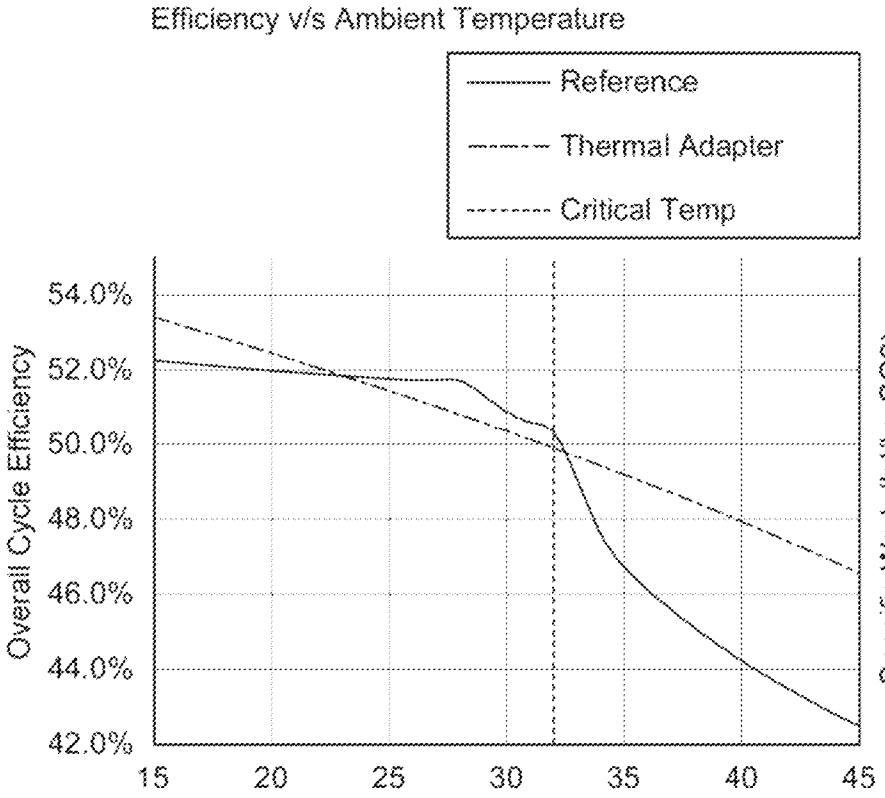

FIG. 9C illustrates model efficiency vs ambient temperature. As illustrated, where the ambient temperature is below the critical temperature of CO2, the efficiency of the reference model is similar to the efficiency of the thermal adapter model. However, as the ambient temperature increases beyond the critical temperature of CO2, the thermal adapter model exhibits far superior efficiency. This is a result of the thermal adapter's ability to provide stable transcritical CO2 temperatures at the condenser.

FIG. 9D illustrates specific work vs ambient temperature of both a reference model and a model with the thermal adapter. As can be seen, the specific work is higher with the thermal adapter across nearly all ambient temperature ranges. As one would expect, as the ambient temperature increases, the improvement of the thermal adapter model increases.

Figure 10:
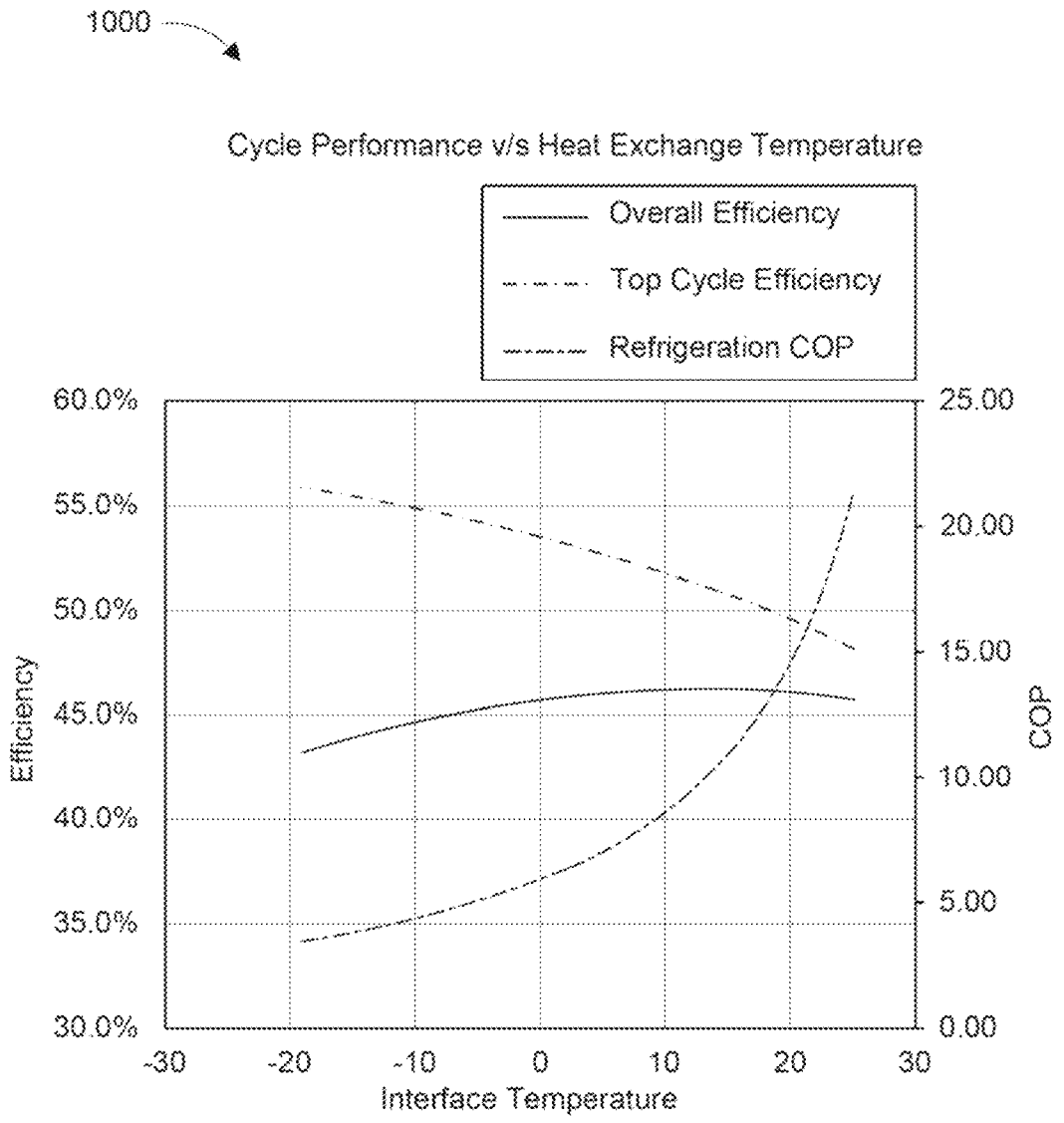
FIG. 10 illustrates a graph of cycle performance vs heat exchange temperature and the effects of incorporating a refrigeration bottoming loop, in accordance with some embodiments.

FIG. 10 illustrates an efficiency graph 1000 of the cycle performance vs the heat exchanger temperature. In a system in which the refrigeration bottoming cycle is integrated with the top CO2 cycle, it can be seen how efficiency of the system changes with the interface temperature between the CO2 and the refrigeration cycle. For ideal operation, an optimal interface temperature point between CO2 and the refrigeration cycle can be located and the system may be configured to operate near the optimal interface temperature. As can be seen from the graph, as the interface temperature increases, the top CO2 cycle efficiency decreases; however, the refrigeration coefficient of performance (COP) drastically increases, which has a tendence to increase overall efficiency over a temperature range.

Results of the embodiments described herein provide constant and stable heat rejection from a CO2 power cycle independent of ambient conditions by incorporating a refrigeration bottoming loop. This provides for predictable heat transfer between a salt loop and a CO2 loop. The salt loop is used as an example working fluid loop that couples the refrigeration bottoming cycle to a heat exchanger in thermal communication with another heat source, such as a nuclear reactor. Some of the described embodiments reduce the CO2 heat sink temperature to below the critical temperature of CO2 to allow for isothermal heat rejections and a condensing sCO2 cycle. The net Carnot efficiency may reduce, but may possibly improve the $2^{nd}$ Law efficiency (e.g., the $2^{nd}$ law of thermodynamics efficiency) due to lower irreversibilities in heat transfer and characteristics of sCO2 cycles.

The potential benefits of the embodiments described herein are especially useful in hot climatic regions where ambient temperature may exceed the CO2 critical temperature.

Moreover, the described embodiments offer higher efficiency, especially as ambient temperatures rise above about 30° C., and likely offers higher efficiencies even at lower temperatures. The specific power of the CO2 is significantly improved over a system without the refrigeration bottoming loop, and the refrigeration loop insulates the power cycle and nuclear heat transfer from ambient conditions. In addition, turbomachinery operation is simpler due to the forced and predictable condensation of the CO2. The heat rejection process and equipment is simpler due to phase change in heat exchangers. Finally, the refrigeration bottoming cycle can be adapted to any sCO2 cycle without regard to the heat source and may be applied to sCO2 systems that utilize any suitable heat source.

The foregoing description of specific embodiments will so fully reveal the general nature of embodiments of the disclosure that others can, by applying knowledge of those of ordinary skill in the art, readily modify and/or adapt for various applications such specific embodiments, without undue experimentation, without departing from the general concept of embodiments of the disclosure. Therefore, such adaptation and modifications are intended to be within the meaning and range of equivalents of the disclosed embodiments, based on the teaching and guidance presented herein. The phraseology or terminology herein is for the purpose of description and not of limitation, such that the terminology or phraseology of the specification is to be interpreted by persons of ordinary skill in the relevant art in light of the teachings and guidance presented herein.

The disclosure sets forth example embodiments and, as such, is not intended to limit the scope of embodiments of the disclosure and the appended claims in any way. Embodiments have been described above with the aid of functional building blocks illustrating the implementation of specified functions and relationships thereof. The boundaries of these functional building blocks have been arbitrarily defined herein for the convenience of the description. Alternate boundaries can be defined to the extent that the specified functions and relationships thereof are appropriately performed.

The breadth and scope of embodiments of the disclosure should not be limited by any of the above-described example embodiments, but should be defined only in accordance with the following claims and their equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

A person of ordinary skill in the art will recognize that any process or method disclosed herein can be modified in many ways. The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed.

The various exemplary methods described and/or illustrated herein may also omit one or more of the steps described or illustrated herein or comprise additional steps in addition to those disclosed. Further, a step of any method as disclosed herein can be combined with any one or more steps of any other method as disclosed herein.

It is, of course, not possible to describe every conceivable combination of elements and/or methods for purposes of describing the various features of the disclosure, but those of ordinary skill in the art recognize that many further combinations and permutations of the disclosed features are possible. Accordingly, various modifications may be made to the disclosure without departing from the scope or spirit thereof. Further, other embodiments of the disclosure may be apparent from consideration of the specification and annexed drawings, and practice of disclosed embodiments as presented herein. Examples put forward in the specification and annexed drawings should be considered, in all respects, as illustrative and not restrictive. Although specific terms are employed herein, they are used in a generic and descriptive sense only, and not used for purposes of limitation.

According to some example embodiments, the systems and/or methods described herein may be under the control of one or more processors. The one or more processors may have access to computer-readable storage media ("CRSM"), which may be any available physical media accessible by the processor(s) to execute instruction stored on the CRSM. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other medium which can be used to store the desired information and which can be accessed by the processor(s). For example, the operation of the refrigeration system and the auxiliary cooling system may be controlled by one or more processors.

Those skilled in the art will appreciate that, in some implementations, the functionality provided by the processes and systems discussed above may be provided in alternative ways, such as being split among more software programs or routines or consolidated into fewer programs or routines. Similarly, in some implementations, illustrated processes and systems may provide more or less functionality than is described, such as when other illustrated processes instead lack or include such functionality respectively, or when the amount of functionality that is provided is altered. In addition, while various operations may be illustrated as being performed in a particular manner (e.g., in serial or in parallel) and/or in a particular order, those skilled in the art will appreciate that in other implementations the operations may be performed in other orders and in other manners.

Unless otherwise noted, the terms "connected to" and "coupled to" (and their derivatives), as used in the specification and/or Appendix, are to be construed as permitting both direct and indirect (i.e., via other elements or components) connection. In addition, the terms "a" or "an," as used in the specification and/or Appendix, are to be construed as meaning "at least one of." Finally, for ease of use, the terms "including" and "having" (and their derivatives), as used in the specification and/or Drawings, are interchangeable with and have the same meaning as the word "comprising."

From the foregoing, and the accompanying Drawings, it will be appreciated that, although specific implementations have been described herein for purposes of illustration, various modifications may be made without deviating from the spirit and scope of the appended claims and the elements recited therein. In addition, while certain aspects are presented below in certain claim forms, the inventors contemplate the various aspects in any available claim form. For example, while only some aspects may currently be recited as being embodied in a particular configuration, other aspects may likewise be so embodied. Various modifications and changes may be made as would be obvious to a person skilled in the art having the benefit of this disclosure. It is intended to embrace all such modifications and changes and, accordingly, the above description is to be regarded in an illustrative rather than a restrictive sense.

What is claimed is:

1. A supercritical carbon dioxide (sCO2) power system comprising:

a thermal energy source;

a turbine configured to receive supercritical CO2 from the thermal energy source and expand the supercritical CO2;

a recuperator configured to receive CO2 from the turbine;

a condenser configured to receive CO2 from the recuperator;

a refrigeration system in thermal communication with the condenser, the refrigeration system configured to provide a heat sink for the CO2 at a temperature below a critical temperature of CO2 to condense the CO2 to a liquid state regardless of an ambient temperature being above or below the critical temperature of CO2;

a pump configured to pump liquid CO2 existing the condenser; and a carbon dioxide (CO2) fluid loop configured to convey CO2 through the fluid loop such that the CO2 transitions from a supercritical state upstream of the turbine, to a gaseous state downstream of the turbine, to a liquid state downstream of the condenser, and back to the supercritical state after being heated by the thermal energy source.

2. The sCO2 power system as in claim 1, further comprising a refrigerant flowing through the refrigeration system, and wherein the refrigerant undergoes a phase change from a liquid phase to a vapor phase as it passes through the condenser, thereby providing two-phase heat transfer on both a CO2 side and a refrigerant side of the condenser.

3. The sCO2 power system as in claim 2, wherein the refrigerant is one of propane and ammonia.

4. The sCO2 power system as in claim 1, wherein the refrigeration system comprises a refrigerant compressor, a refrigerant condenser, and an expansion valve, wherein the expansion valve is configured to reduce pressure and temperature of refrigerant exiting the refrigerant condenser before the refrigerant enters the condenser to absorb heat from the CO2.

5. The sCO2 power system as in claim 1, wherein the recuperator is located and configured to receive hot CO2 in a gaseous state from the turbine and transfer heat to cold liquid CO2 after it exits the condenser, thereby preheating the liquid CO2 before the liquid CO2 is heated by the thermal energy source.

6. The sCO2 power system as in claim 1, further comprising a generator operatively coupled to the turbine and configured to receive kinetic energy from the turbine and use the kinetic energy to generate electricity.

7. The sCO2 power system as in claim 1, further comprising a compressor operatively coupled to the turbine to receive kinetic energy from the turbine and compress refrigerant in a refrigeration system.

8. The sCO2 power system as in claim 1, further comprising a CO2 compressor operatively coupled to the turbine to receive kinetic energy from the turbine and compress CO2 within the CO2 fluid loop.

9. The sCO2 power system as in claim 1, wherein the refrigeration system is configured to be selectively disengaged from the condenser.

10. The sCO2 power system as in claim 9, further comprising an auxiliary cooling system in selective engagement with the condenser and configured to supplant the refrigeration system in response to ambient temperature falling below a threshold.

11. The sCO2 power system as in claim 1, wherein the thermal energy source is a nuclear reactor, and wherein the condenser supplies CO2 at a temperature below an ambient temperature.

12. The sCO2 power system as in claim 11, wherein the condenser supplies CO2 to the nuclear reactor at a temperature that is predetermined and stable.

13. The sCO2 power system as in claim 1, further comprising a heat exchanger that thermally couples the thermal energy source with the CO2 fluid loop.

14. A method, comprising:

operating a heat generator to raise CO2 to a temperature and pressure above its critical point to a supercritical phase to result in supercritical CO2 (sCO2);

causing the sCO2 to flow through a turbine, wherein CO2 exits the turbine in a gaseous state;

operating a refrigeration cycle and causing a refrigerant to flow through a carbon dioxide (CO2) condenser to provide a heat sink at a temperature below a critical temperature of CO2 regardless of whether an ambient temperature is above or below the critical temperature of CO2;

causing the CO2 that exits the turbine to flow through the CO2 condenser and condense to a liquid CO2; and pumping the liquid CO2 to the heat generator to cause it to become supercritical, whereby the CO2 undergoes a transcritical cycle transitioning through supercritical, gaseous, and liquid phases.

15. The method of claim 14, wherein operating the refrigeration cycle comprises providing a refrigerant at a temperature below an ambient temperature and causing a heat exchange between the CO2 and the refrigerant to cause the CO2 to undergo a phase change from a vapor to a liquid.

16. The method of claim 14, further comprising the step of disengaging the refrigeration cycle in response to an ambient temperature falling below a threshold temperature.

17. The method of claim 14, further comprising transferring heat from the CO2 exiting the turbine to the liquid CO2 exiting the condenser in a recuperator before the CO2 exiting the turbine enters the condenser.

* * * * *